US008309018B2

(12) United States Patent
Smith et al.

(10) Patent No.: US 8,309,018 B2
(45) **Date of Patent: *Nov. 13, 2012**

(54) EARTH-BORING ROTARY DRILL BITS AND METHODS OF MANUFACTURING EARTH-BORING ROTARY DRILL BITS HAVING PARTICLE-MATRIX COMPOSITE BIT BODIES

(75) Inventors: Redd H. Smith, The Woodlands, TX (US); John H. Stevens, Spring, TX (US); James L. Duggan, Friendswood, TX (US); Nicholas J. Lyons, Houston, TX (US); Jimmy W. Eason, The Woodlands, TX (US); Jared D. Gladney, Katy, TX (US); James A. Oxford, Magnolia, TX (US); Benjamin J. Chrest, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 65 days.

This patent is subject to a terminal disclaimer.

(21) Appl. No.: 12/827,968

(22) Filed: Jun. 30, 2010

(65) Prior Publication Data

US 2010/0263935 A1 Oct. 21, 2010

Related U.S. Application Data

(63) Continuation of application No. 11/272,439, filed on Nov. 10, 2005, now Pat. No. 7,776,256.

(51) Int. Cl.
*B22F 7/00* (2006.01)
*B21K 5/04* (2006.01)
*E21B 10/54* (2006.01)

(52) U.S. Cl. ..... 419/6; 419/10; 419/12; 419/13; 419/14; 419/18; 419/28; 419/42; 419/47; 76/108.2; 175/425

(58) Field of Classification Search ..... 419/6, 10, 419/12–14, 18, 28, 42, 48; 175/375, 425; 76/108.2
See application file for complete search history.

(56) References Cited

U.S. PATENT DOCUMENTS 1,954,166 A 4/1934 Campbell (Continued)

FOREIGN PATENT DOCUMENTS

AU 695583 2/1998

(Continued)

OTHER PUBLICATIONS

U.S. Appl. No. 60/566,063, filed Apr. 28 2004 entitled "Body Materials for Earth Boring Bits" to Mirchandani et al.

(Continued)

*Primary Examiner* — Roy King
*Assistant Examiner* — Ngoclan T Mai
(74) *Attorney, Agent, or Firm* — TraskBritt

(57) ABSTRACT

Methods of forming bit bodies for earth-boring bits include assembling green components, brown components, or fully sintered components, and sintering the assembled components. Other methods include isostatically pressing a powder to form a green body substantially composed of a particle-matrix composite material, and sintering the green body to provide a bit body having a desired final density. Methods of forming earth-boring bits include providing a bit body substantially formed of a particle-matrix composite material and attaching a shank to the body. The body is provided by pressing a powder to form a green body and sintering the green body. Earth-boring bits include a unitary structure substantially formed of a particle-matrix composite material. The unitary structure includes a first region configured to carry cutters and a second region that includes a threaded pin. Earth-boring bits include a shank attached directly to a body substantially formed of a particle-matrix composite material.

20 Claims, 11 Drawing Sheets

U.S. PATENT DOCUMENTS

| | | | |
|---|---|---|---|
| 2,299,207 | A | 10/1942 | Bevillard |
| 2,507,439 | A | 5/1950 | Goolsbee |
| 2,819,958 | A | 1/1958 | Abkowitz et al. |
| 2,819,959 | A | 1/1958 | Abkowitz et al. |
| 2,906,654 | A | 9/1959 | Abkowitz |
| 3,368,881 | A | 2/1968 | Abkowitz et al. |
| 3,471,921 | A | 10/1969 | Feenstra |
| 3,660,050 | A | 5/1972 | Iler et al. |
| 3,757,879 | A | 9/1973 | Wilder et al. |
| 3,880,971 | A | 4/1975 | Pantanelli |
| 3,987,859 | A | 10/1976 | Lichte |
| 4,017,480 | A | 4/1977 | Baum |
| 4,047,828 | A | 9/1977 | Makely |
| 4,094,709 | A | 6/1978 | Rozmus |
| 4,128,136 | A | 12/1978 | Generoux |
| 4,134,759 | A | 1/1979 | Yajima et al. |
| 4,157,122 | A | 6/1979 | Morris |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,252,202 | A | 2/1981 | Purser, Sr. |
| 4,255,165 | A | 3/1981 | Dennis et al. |
| 4,306,139 | A | 12/1981 | Shinozaki et al. |
| 4,341,557 | A | 7/1982 | Lizenby |
| 4,389,952 | A | 6/1983 | Dreier et al. |
| 4,398,952 | A | 8/1983 | Drake |
| 4,453,605 | A | 6/1984 | Short et al. |
| 4,499,048 | A | 2/1985 | Hanejko |
| 4,499,795 | A | 2/1985 | Radtke |
| 4,499,958 | A | 2/1985 | Radtke et al. |
| 4,503,009 | A | 3/1985 | Asaka |
| 4,526,748 | A | 7/1985 | Rozmus |
| 4,547,337 | A | 10/1985 | Rozmus |
| 4,552,232 | A | 11/1985 | Frear |
| 4,554,130 | A | 11/1985 | Ecer |
| 4,562,990 | A | 1/1986 | Rose |
| 4,596,694 | A | 6/1986 | Rozmus |
| 4,597,730 | A | 7/1986 | Rozmus |
| 4,620,600 | A | 11/1986 | Persson |
| 4,630,693 | A | 12/1986 | Goodfellow |
| 4,656,002 | A | 4/1987 | Lizenby et al. |
| 4,667,756 | A | 5/1987 | King et al. |
| 4,686,080 | A | 8/1987 | Hara et al. |
| 4,694,919 | A | 9/1987 | Barr |
| 4,743,515 | A | 5/1988 | Fischer et al. |
| 4,744,943 | A | 5/1988 | Timm |
| 4,774,211 | A | 9/1988 | Hamilton et al. |
| 4,809,903 | A | 3/1989 | Eylon et al. |
| 4,838,366 | A | 6/1989 | Jones |
| 4,871,377 | A | 10/1989 | Frushour |
| 4,881,431 | A | 11/1989 | Bieneck |
| 4,884,477 | A | 12/1989 | Smith et al. |
| 4,889,017 | A | 12/1989 | Fuller et al. |
| 4,919,013 | A | 4/1990 | Smith et al. |
| 4,923,512 | A | 5/1990 | Timm et al. |
| 4,956,012 | A | 9/1990 | Jacobs et al. |
| 4,968,348 | A | 11/1990 | Abkowitz et al. |
| 4,981,665 | A | 1/1991 | Boecker et al. |
| 5,000,273 | A | 3/1991 | Horton et al. |
| 5,030,598 | A | 7/1991 | Hsieh |
| 5,032,352 | A | 7/1991 | Meeks et al. |
| 5,049,450 | A | 9/1991 | Dorfman et al. |
| 5,090,491 | A | 2/1992 | Tibbits et al. |
| 5,101,692 | A | 4/1992 | Simpson |
| 5,150,636 | A | 9/1992 | Hill |
| 5,161,898 | A | 11/1992 | Drake |
| 5,232,522 | A | 8/1993 | Doktycz et al. |
| 5,281,260 | A | 1/1994 | Kumar et al. |
| 5,286,685 | A | 2/1994 | Schoennahl et al. |
| 5,311,958 | A | 5/1994 | Isbell et al. |
| 5,322,139 | A | 6/1994 | Rose et al. |
| 5,333,699 | A | 8/1994 | Thigpen et al. |
| 5,348,806 | A | 9/1994 | Kojo et al. |
| 5,372,777 | A | 12/1994 | Yang |
| 5,373,907 | A | 12/1994 | Weaver |
| 5,433,280 | A | 7/1995 | Smith |
| 5,439,068 | A | 8/1995 | Huffstutler et al. |
| 5,439,608 | A | 8/1995 | Kondrats |
| 5,443,337 | A | 8/1995 | Katayama |
| 5,455,000 | A | 10/1995 | Seyferth et al. |
| 5,467,669 | A | 11/1995 | Stroud |
| 5,479,997 | A | 1/1996 | Scott et al. |
| 5,482,670 | A | 1/1996 | Hong |
| 5,484,468 | A | 1/1996 | Ostlund et al. |
| 5,506,055 | A | 4/1996 | Dorfman et al. |
| 5,541,006 | A | 7/1996 | Conley |
| 5,543,235 | A | 8/1996 | Mirchandani et al. |
| 5,544,550 | A | 8/1996 | Smith |
| 5,560,440 | A | 10/1996 | Tibbitts |
| 5,586,612 | A | 12/1996 | Isbell et al. |
| 5,593,474 | A | 1/1997 | Keshayan et al. |
| 5,611,251 | A | 3/1997 | Katayama |
| 5,612,264 | A | 3/1997 | Nilsson et al. |
| 5,624,002 | A | 4/1997 | Huffstutler |
| 5,641,029 | A | 6/1997 | Beaton et al. |
| 5,641,251 | A | 6/1997 | Leins et al. |
| 5,641,921 | A | 6/1997 | Dennis et al. |
| 5,662,183 | A | 9/1997 | Fang |
| 5,666,864 | A | 9/1997 | Tibbitts |
| 5,677,042 | A | 10/1997 | Massa et al. |
| 5,679,445 | A | 10/1997 | Massa et al. |
| 5,697,046 | A | 12/1997 | Conley |
| 5,697,462 | A | 12/1997 | Grimes et al. |
| 5,710,969 | A | 1/1998 | Newman |
| 5,732,783 | A | 3/1998 | Truax et al. |
| 5,733,649 | A | 3/1998 | Kelley et al. |
| 5,733,664 | A | 3/1998 | Kelley et al. |
| 5,740,872 | A | 4/1998 | Smith |
| 5,753,160 | A | 5/1998 | Takeuchi et al. |
| 5,765,095 | A | 6/1998 | Flak et al. |
| 5,776,593 | A | 7/1998 | Massa et al. |
| 5,778,301 | A | 7/1998 | Hong |
| 5,789,686 | A | 8/1998 | Massa et al. |
| 5,792,403 | A | 8/1998 | Massa et al. |
| 5,806,934 | A | 9/1998 | Massa et al. |
| 5,829,539 | A | 11/1998 | Newton et al. |
| 5,830,256 | A | 11/1998 | Northrop et al. |
| 5,856,626 | A | 1/1999 | Fischer et al. |
| 5,865,571 | A | 2/1999 | Tankala et al. |
| 5,878,634 | A | 3/1999 | Tibbitts |
| 5,880,382 | A | 3/1999 | Fang et al. |
| 5,897,830 | A | 4/1999 | Abkowitz et al. |
| 5,904,212 | A | 5/1999 | Arfele |
| 5,947,214 | A | 9/1999 | Tibbitts |
| 5,957,006 | A | 9/1999 | Smith |
| 5,963,775 | A | 10/1999 | Fang |
| 5,967,248 | A | 10/1999 | Drake et al. |
| 5,980,602 | A | 11/1999 | Carden |
| 6,029,544 | A | 2/2000 | Katayama |
| 6,045,750 | A | 4/2000 | Drake et al. |
| 6,051,171 | A | 4/2000 | Takeuchi et al. |
| 6,063,333 | A | 5/2000 | Dennis |
| 6,068,070 | A | 5/2000 | Scott |
| 6,073,518 | A | 6/2000 | Chow et al. |
| 6,086,980 | A | 7/2000 | Foster et al. |
| 6,089,123 | A | 7/2000 | Chow et al. |
| 6,099,664 | A | 8/2000 | Davies et al. |
| 6,135,218 | A | 10/2000 | Deane et al. |
| 6,148,936 | A | 11/2000 | Evans et al. |
| 6,200,514 | B1 | 3/2001 | Meister |
| 6,209,420 | B1 | 4/2001 | Butcher et al. |
| 6,214,134 | B1 | 4/2001 | Eylon et al. |
| 6,214,287 | B1 | 4/2001 | Waldenstrom |
| 6,220,117 | B1 | 4/2001 | Butcher |
| 6,227,188 | B1 | 5/2001 | Tankala et al. |
| 6,228,139 | B1 | 5/2001 | Oskarrason |
| 6,241,036 | B1 | 6/2001 | Lovato et al. |
| 6,254,658 | B1 | 7/2001 | Taniuchi et al. |
| 6,284,014 | B1 | 9/2001 | Carden |
| 6,287,360 | B1 | 9/2001 | Kembaiyan et al. |
| 6,290,438 | B1 | 9/2001 | Papajewski |
| 6,293,986 | B1 | 9/2001 | Rodiger et al. |
| 6,322,746 | B1 | 11/2001 | LaSalle et al. |
| 6,348,110 | B1 | 2/2002 | Evans |
| 6,375,706 | B2 | 4/2002 | Kembaiyan et al. |
| 6,408,958 | B1 | 6/2002 | Isbell et al. |

| | | | | |
|---|---|---|---|---|
| 6,453,899 | B1 | 9/2002 | Tselesin | |
| 6,454,025 | B1 | 9/2002 | Runquist et al. | |
| 6,454,030 | B1 | 9/2002 | Findley et al. | |
| 6,458,471 | B2 | 10/2002 | Lovato et al. | |
| 6,474,424 | B1 | 11/2002 | Saxman | |
| 6,474,425 | B1 | 11/2002 | Truax et al. | |
| 6,500,226 | B1 | 12/2002 | Dennis | |
| 6,511,265 | B1 | 1/2003 | Mirchandani et al. | |
| 6,576,182 | B1 | 6/2003 | Ravagni et al. | |
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,651,756 | B1 | 11/2003 | Costo, Jr. et al. | |
| 6,655,481 | B2 | 12/2003 | Findley et al. | |
| 6,685,880 | B2 | 2/2004 | Engstrom et al. | |
| 6,742,608 | B2 | 6/2004 | Murdoch | |
| 6,742,611 | B1 | 6/2004 | Illerhaus et al. | |
| 6,756,009 | B2 | 6/2004 | Sim et al. | |
| 6,766,870 | B2 | 7/2004 | Overstreet | |
| 6,849,231 | B2 | 2/2005 | Kojima et al. | |
| 6,908,688 | B1 | 6/2005 | Majagi et al. | |
| 6,918,942 | B2 | 7/2005 | Hatta et al. | |
| 7,044,243 | B2 | 5/2006 | Kembaiyan et al. | |
| 7,048,081 | B2 | 5/2006 | Smith et al. | |
| 7,395,882 | B2 | 7/2008 | Oldham et al. | |
| 7,776,256 | B2 | 8/2010 | Smith et al. | |
| 7,807,099 | B2 | 10/2010 | Choe et al. | |
| 7,954,569 | B2 * | 6/2011 | Mirchandani et al. | 175/425 |
| 2001/0000591 | A1 | 5/2001 | Tibbitts | |
| 2002/0004105 | A1 | 1/2002 | Kunze et al. | |
| 2003/0010409 | A1 | 1/2003 | Kunze et al. | |
| 2003/0079916 | A1 * | 5/2003 | Oldham et al. | 175/374 |
| 2004/0007393 | A1 | 1/2004 | Griffin | |
| 2004/0013558 | A1 | 1/2004 | Kondoh et al. | |
| 2004/0060742 | A1 | 4/2004 | Kembaiyan et al. | |
| 2004/0196638 | A1 | 10/2004 | Lee et al. | |
| 2004/0243241 | A1 | 12/2004 | Istephanous et al. | |
| 2004/0245022 | A1 | 12/2004 | Izaguirre et al. | |
| 2004/0245024 | A1 | 12/2004 | Kembaiyan | |
| 2005/0008524 | A1 | 1/2005 | Testani | |
| 2005/0072496 | A1 | 4/2005 | Hwang et al. | |
| 2005/0072601 | A1 * | 4/2005 | Griffo et al. | 175/374 |
| 2005/0084407 | A1 | 4/2005 | Myrick | |
| 2005/0117984 | A1 | 6/2005 | Eason et al. | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |
| 2006/0231293 | A1 | 10/2006 | Ladi et al. | |
| 2007/0042217 | A1 | 2/2007 | Fang et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2008/0202814 | A1 | 8/2008 | Lyons et al. | |
| 2009/0044663 | A1 | 2/2009 | Stevens et al. | |

FOREIGN PATENT DOCUMENTS

| | | | |
|---|---|---|---|
| CA | 2212197 | | 2/2000 |
| EP | 0264674 | | 4/1988 |
| EP | 0453428 | A1 | 10/1991 |
| EP | 0995876 | A2 | 4/2000 |
| EP | 1244531 | B1 | 10/2002 |
| GB | 945227 | | 12/1963 |
| GB | 2017153 | | 10/1979 |
| GB | 2203774 | A | 10/1988 |
| GB | 2345930 | A | 7/2000 |
| GB | 2385350 | A | 8/2003 |
| GB | 2393449 | A | 3/2004 |
| JP | 10219385 | A | 8/1998 |
| WO | 03049889 | A2 | 6/2003 |
| WO | 2004053197 | A2 | 6/2004 |

OTHER PUBLICATIONS

US 4,966,627, 10/1990, Keshavan et al. (withdrawn).

"Boron Carbide Nozzles and Inserts," Seven Stars International webpage http://www.concentric.net/~ctkang/nozzle.shtml, printed Sep. 7, 2006, 8 pages.

"Heat Treating of Titanium and Titanium Alloys," Key to Metals website article, www.key-to-metals.com, printed Sep. 21, 2006, 7 pages.

Alman et al., "The Abrasive Wear of Sintered Titanium Matrix-Ceramic Particle Reinforced Composites," WEAR, 225-229 (1999), pp. 629-639.

Choe et al., "Effect of Tungsten Additions on the Mechanical Properties of Ti-6A1-4V," Material Science and Engineering, A 396 (2005), pp. 99-106.

Diamond Innovations, "Composite Diamond Coatings, Superhard Protection of Wear Parts New Coating and Service Parts from Diamond Innovations" Brochure, 2004, 7 pages.

Gale et al., Smithells Metals Reference Book, Eighth Edition, 2003, p. 2117.

International Search Report and Written Opinion of the International Search Authority for PCT Counterpart Application No. PCT/US2006/043669, mailed Apr. 13, 2007.

International Search Report and Written Opinion of the International Search Authority for International Application No. PCT/US2006/043670, mailed Apr. 2, 2007.

International Search Report for International PCT International Application No. PCT/US2007/023275, mailed Apr. 11, 2008.

International Search Report for International Application No. PCT/US2009/046812 dated Jan. 26, 2010, 5 pages.

International Written Opinion for International Application No. PCT/US2009/046812 dated Jan. 26, 2010, 5 pages.

Miserez et al. "Particle Reinforced Metals of High Ceramic Content," Material Science and Engineering A 387-389 (2004), pp. 822-831.

Reed, "Chapter 13: Particle Packing Characteristics," Principles of Ceramics Processing, Second Edition, John Wiley & Sons, Inc. (1995), pp. 215-227.

Warrier et al., "Infiltration of Titanium Alloy-Matrix Composites," Journal of Materials Science Letters, 12 (1993), pp. 865-868, Chapman & Hall.

* cited by examiner

EARTH-BORING ROTARY DRILL BITS AND METHODS OF MANUFACTURING EARTH-BORING ROTARY DRILL BITS HAVING PARTICLE-MATRIX COMPOSITE BIT BODIES

CROSS-REFERENCE TO RELATED APPLICATIONS

This application is a continuation of U.S. patent application Ser. No. 11/272,439, filed Nov. 10, 2005, now U.S. Pat. No. 7,776,256, issued Aug. 17, 2010, which application is related to U.S. patent application Ser. No. 11/271,153, filed on Nov. 10, 2005, now U.S. Pat. No. 7,802,495, issued Sep. 28, 2010, and entitled "Earth-Boring Rotary Drill Bits And Methods Of Forming Earth-Boring Rotary Drill Bits," assigned to the assignee of the present application, the entire disclosure of each of which is hereby incorporated herein by reference. The subject matter of this application is also related to the subject matter of U.S. patent application Ser. No. 11/116,752, filed on Apr. 28, 2005, now U.S. Pat. No. 7,954,569, issued Jun. 7, 2011, and entitled "Earth-Boring Bits," the entire disclosure of which is incorporated herein by reference.

BACKGROUND OF THE INVENTION

1. Field of the Invention

The present invention generally relates to earth-boring rotary drill bits, and to methods of manufacturing such earth-boring rotary drill bits. More particularly, the present invention generally relates to earth-boring rotary drill bits that include a bit body substantially formed of a particle-matrix composite material, and to methods of manufacturing such earth-boring drill bits.

2. State of the Art

Rotary drill bits are commonly used for drilling bore holes or wells in earth formations. Rotary drill bits include two primary configurations. One configuration is the roller cone bit, which typically includes three roller cones mounted on support legs that extend from a bit body. Each roller cone is configured to spin or rotate on a support leg. Cutting teeth typically are provided on the outer surfaces of each roller cone for cutting rock and other earth formations. The cutting teeth often are coated with an abrasive super hard ("hardfacing") material. Such materials often include tungsten carbide particles dispersed throughout a metal alloy matrix material. Alternatively, receptacles are provided on the outer surfaces of each roller cone into which hardmetal inserts are secured to form the cutting elements. The roller cone drill bit may be placed in a bore hole such that the roller cones are adjacent the earth formation to be drilled. As the drill bit is rotated, the roller cones roll across the surface of the formation, the cutting teeth crushing the underlying formation.

A second configuration of a rotary drill bit is the fixed-cutter bit (often referred to as a "drag" bit), which typically includes a plurality of cutting elements secured to a face region of a bit body. Generally, the cutting elements of a fixed-cutter type drill bit have either a disk shape or a substantially cylindrical shape. A hard, super-abrasive material, such as mutually bonded particles of polycrystalline diamond, may be provided on a substantially circular end surface of each cutting element to provide a cutting surface. Such cutting elements are often referred to as "polycrystalline diamond compact" (PDC) cutters. Typically, the cutting elements are fabricated separately from the bit body and secured within pockets formed in the outer surface of the bit body. A bonding material such as an adhesive or, more typically, a braze alloy may be used to secure the cutting elements to the bit body. The fixed-cutter drill bit may be placed in a bore hole such that the cutting elements are adjacent the earth formation to be drilled. As the drill bit is rotated, the cutting elements scrape across and shear away the surface of the underlying formation.

The bit body of a rotary drill bit typically is secured to a hardened steel shank having an American Petroleum Institute (API) threaded pin for attaching the drill bit to a drill string. The drill string includes tubular pipe and equipment segments coupled end to end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such materials include hard particles randomly dispersed throughout a matrix material (often referred to as a "binder" material). Such bit bodies typically are formed by embedding a steel blank in a carbide particulate material volume, such as particles of tungsten carbide, and infiltrating the particulate carbide material with a matrix material, such as a copper alloy. Drill bits that have a bit body formed from such a particle-matrix composite material may exhibit increased erosion and wear resistance, but lower strength and toughness relative to drill bits having steel bit bodies.

A conventional earth-boring rotary drill bit 10 that has a bit body including a particle-matrix composite material is illustrated in FIG. 1. As seen therein, the drill bit 10 includes a bit body 12 that is secured to a steel shank 20. The bit body 12 includes a crown 14, and a steel blank 16 that is embedded in the crown 14. The crown 14 includes a particle-matrix composite material such as, for example, particles of tungsten carbide embedded in a copper alloy matrix material. The bit body 12 is secured to the steel shank 20 by way of a threaded connection 22 and a weld 24 that extends around the drill bit 10 on an exterior surface thereof along an interface between the bit body 12 and the steel shank 20. The steel shank 20 includes an API threaded pin 28 for attaching the drill bit 10 to a drill string (not shown).

The bit body 12 includes wings or blades 30, which are separated by junk slots 32. Internal fluid passageways 42 extend between the face 18 of the bit body 12 and a longitudinal bore 40, which extends through the steel shank 20 and partially through the bit body 12. Nozzle inserts (not shown) may be provided at face 18 of the bit body 12 within the internal fluid passageways 42.

A plurality of PDC cutters 34 are provided on the face 18 of the bit body 12. The PDC cutters 34 may be provided along the blades 30 within pockets 36 formed in the face 18 of the bit body 12, and may be supported from behind by buttresses 38, which may be integrally formed with the crown 14 of the bit body 12.

The steel blank 16 shown in FIG. 1 is generally cylindrically tubular. Alternatively, the steel blank 16 may have a fairly complex configuration and may include external protrusions corresponding to blades 30 or other features extending on the face 18 of the bit body 12.

During drilling operations, the drill bit 10 is positioned at the bottom of a well bore hole and rotated while drilling fluid is pumped to the face 18 of the bit body 12 through the longitudinal bore 40 and the internal fluid passageways 42. As the PDC cutters 34 shear or scrape away the underlying earth formation, the formation cuttings and detritus are mixed with and suspended within the drilling fluid, which passes through the junk slots 32 and the annular space between the well bore hole and the drill string to the surface of the earth formation.

Conventionally, bit bodies that include a particle-matrix composite material, such as the previously described bit body 12, have been fabricated by infiltrating hard particles with molten matrix material in graphite molds. The cavities of the graphite molds are conventionally machined with a five-axis machine tool. Fine features are then added to the cavity of the graphite mold by hand-held tools. Additional clay work also may be required to obtain the desired configuration of some features of the bit body. Where necessary, preform elements or displacements (which may comprise ceramic components, graphite components, or resin-coated sand compact components) may be positioned within the mold and used to define the internal fluid passageways 42, cutting element pockets 36, junk slots 32, and other external topographic features of the bit body 12. The cavity of the graphite mold is filled with hard particulate carbide material (such as tungsten carbide, titanium carbide, tantalum carbide, etc.). The preformed steel blank 16 may then be positioned in the mold at the appropriate location and orientation. The steel blank 16 typically is at least partially submerged in the particulate carbide material within the mold.

The mold then may be vibrated, or the particles otherwise packed, to decrease the amount of space between adjacent particles of the particulate carbide material. A matrix material, such as a copper-based alloy, may be melted, and the particulate carbide material may be infiltrated with the molten matrix material. The mold and bit body 12 are allowed to cool to solidify the matrix material. The steel blank 16 is bonded to the particle-matrix composite material, which forms the crown 14, upon cooling of the bit body 12 and solidification of the matrix material. Once the bit body 12 has cooled, the bit body 12 is removed from the mold and any displacements are removed from the bit body 12. Destruction of the graphite mold typically is required to remove the bit body 12.

As previously described, destruction of the graphite mold typically is required to remove the bit body 12. After the bit body 12 has been removed from the mold, the bit body 12 may be secured to the steel shank 20. As the particle-matrix composite material used to form the crown 14 is relatively hard and not easily machined, the steel blank 16 is used to secure the bit body 12 to the shank 20. Threads may be machined on an exposed surface of the steel blank 16 to provide the threaded connection 22 between the bit body 12 and the steel shank 20. The steel shank 20 may be screwed onto the bit body 12, and the weld 24 then may be provided along the interface between the bit body 12 and the steel shank 20.

The PDC cutters 34 may be bonded to the face 18 of the bit body 12 after the bit body 12 has been cast by, for example, brazing, mechanical affixation, or adhesive affixation. Alternatively, the PDC cutters 34 may be provided within the mold and bonded to the face 18 of the bit body 12 during infiltration or furnacing of the bit body 12 if thermally stable synthetic diamonds, or natural diamonds, are employed.

The molds used to cast bit bodies are difficult to machine due to their size, shape, and material composition. Furthermore, manual operations using hand-held tools are often required to form a mold and to form certain features in the bit body after removing the bit body from the mold, which further complicates the reproducibility of bit bodies. These facts, together with the fact that only one bit body can be cast using a single mold, complicate reproduction of multiple bit bodies having consistent dimensions. As a result, there may be variations in cutter placement in or on the face of the bit bodies. Due to these variations, the shape, strength, and ultimately the performance during drilling of each bit body may vary, which makes it difficult to ascertain the life expectancy of a given drill bit. As a result, the drill bits on a drill string are typically replaced more often than is desirable, in order to prevent unexpected drill bit failures, which results in additional costs.

As may be readily appreciated from the foregoing description, the process of fabricating a bit body that includes a particle-matrix composite material is a somewhat costly, complex, multi-step, labor-intensive process requiring separate fabrication of an intermediate product (the mold) before the end product (the bit body) can be cast. Moreover, the blanks, molds, and any preforms employed must be individually designed and fabricated. While bit bodies that include particle-matrix composite materials may offer significant advantages over prior art steel-body bits in terms of abrasion and erosion-resistance, the lower strength and toughness of such bit bodies prohibit their use in certain applications.

Therefore, it would be desirable to provide a method of manufacturing a bit body that includes a particle-matrix composite material that eliminates the need of a mold, and that provides a bit body of higher strength and toughness that can be easily attached to a shank or other component of a drill string.

Furthermore, the known methods for forming a bit body that includes a particle-matrix composite material require that the matrix material be heated to a temperature above the melting point of the matrix material. Certain materials that exhibit good physical properties for a matrix material are not suitable for use because of detrimental interactions between the particles and matrix, which may occur when the particles are infiltrated by the particular molten matrix material. As a result, a limited number of alloys are suitable for use as a matrix material. Therefore, it would be desirable to provide a method of manufacturing suitable for producing a bit body that includes a particle-matrix composite material that does not require infiltration of hard particles with a molten matrix material.

BRIEF SUMMARY OF THE INVENTION

In one aspect, the present invention includes a method of forming a bit body for an earth-boring drill bit. A plurality of green powder components are provided and assembled to form a green unitary structure. At least one green powder component is configured to form a region of a bit body. The green unitary structure is at least partially sintered.

In another aspect, the present invention includes another method of forming a bit body for an earth-boring drill bit. A plurality of green powder components are provided and at least partially sintered to form a plurality of brown components. At least one green powder component is configured to form a crown region of a bit body. The brown components are assembled to form a brown unitary structure, which is sintered to a final density.

In another aspect, the present invention includes yet another method of forming a bit body for an earth-boring drill bit. A plurality of green powder components is provided and sintered to a desired final density to provide a plurality of fully sintered components. At least one green powder component is configured to form a crown region of a bit body. The fully sintered components are assembled to form a unitary structure, which is sintered to bond the fully sintered components together.

In still another aspect, the present invention includes a method of forming an earth-boring rotary drill bit. The method includes providing a bit body substantially formed of a particle-matrix composite material, providing a shank that is configured for attachment to a drill string; and attaching the shank to the bit body. The bit body is provided by pressing a powder mixture to form a green bit body and at least partially sintering the green bit body. The powder mixture includes a plurality of hard particles and a plurality of particles comprising a matrix material. The hard particles may be selected from the group consisting of diamond, boron carbide, boron nitride, aluminum nitride, and carbides or borides of the group consisting of W, Ti, Mo, Nb, V, Hf, Zr, and Cr. The matrix material may be selected from the group consisting of cobalt-based alloys, iron-based alloys, nickel-based alloys, cobalt and nickel-based alloys, iron and nickel-based alloys, iron and cobalt-based alloys, aluminum-based alloys, copper-based alloys, magnesium-based alloys, and titanium-based alloys.

In another aspect, the present invention includes another method of forming an earth-boring rotary drill bit. The method includes providing a bit body substantially formed of a particle-matrix composite material that includes a plurality of hard particles dispersed throughout a matrix material, providing a shank that is configured for attachment to a drill string, and attaching the shank to the bit body. The bit body is provided by forming a first brown component, forming at least one additional brown component, assembling the first brown component with the at least one additional brown component to form a brown bit body, and sintering the brown bit body to a final density. The first brown component is formed by providing a first powder mixture, pressing the first powder mixture to form a first green component, and partially sintering the first green component. The at least one additional brown component is formed by providing at least one additional powder mixture that is different from the first powder mixture, pressing the at least one additional powder mixture to form at least one additional green component, and partially sintering the at least one additional green component.

In still another aspect, the present invention includes a method of forming a bit body for an earth-boring rotary drill bit. The method includes providing a powder mixture, pressing the powder mixture with substantially isostatic pressure to form a green body substantially composed of a particle-matrix composite material, and sintering the green body to provide a bit body substantially composed of a particle-matrix composite material having a desired final density. The powder mixture includes a plurality of hard particles, a plurality of particles comprising a matrix material, and a binder material. The hard particles may be selected from the group consisting of diamond, boron carbide, boron nitride, aluminum nitride, and carbides or borides of the group consisting of W, Ti, Mo, Nb, V, Hf, Zr, and Cr. The matrix material may be selected from the group consisting of cobalt-based alloys, iron-based alloys, nickel-based alloys, cobalt and nickel-based alloys, iron and nickel-based alloys, iron and cobalt-based alloys, aluminum-based alloys, copper-based alloys, magnesium-based alloys, and titanium-based alloys.

In yet another aspect, the present invention includes an earth-boring rotary drill bit that includes a unitary structure substantially formed of a particle-matrix composite material. The unitary structure includes a first region configured to carry a plurality of cutters for cutting an earth formation and at least one additional region configured to attach the drill bit to a drill string. The at least one additional region includes a threaded pin.

In yet another aspect, the present invention includes an earth-boring rotary drill bit having a bit body substantially formed of a particle-matrix composite material and a shank attached directly to the bit body. The shank includes a threaded portion configured to attach the shank to a drill string. The particle-matrix composite material of the bit body includes a plurality of hard particles randomly dispersed throughout a matrix material. The hard particles may be selected from the group consisting of diamond, boron carbide, boron nitride, aluminum nitride, and carbides or borides of the group consisting of W, Ti, Mo, Nb, V, Hf, Zr, and Cr. The matrix material may be selected from the group consisting of cobalt-based alloys, iron-based alloys, nickel-based alloys, cobalt and nickel-based alloys, iron and nickel-based alloys, iron and cobalt-based alloys, aluminum-based alloys, copper-based alloys, magnesium-based alloys, and titanium-based alloys.

The features, advantages, and alternative aspects of the present invention will be apparent to those skilled in the art from a consideration of the following detailed description considered in combination with the accompanying drawings.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

The illustrations presented herein are not meant to be actual views of any particular material, apparatus, system, or method, but are merely idealized representations which are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

The term "sintering" as used herein means densification of a particulate component involving removal of at least a portion of the pores between the starting particles (accompanied by shrinkage) combined with coalescence and bonding between adjacent particles.

As used herein, the term "[metal]-based alloy" (where [metal] is any metal) means commercially pure [metal] in addition to metal alloys wherein the weight percentage of [metal] in the alloy is greater than the weight percentage of any other component of the alloy.

As used herein, the term "material composition" means the chemical composition and microstructure of a material. In other words, materials having the same chemical composition but a different microstructure are considered to have different material compositions.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

Figure 1:
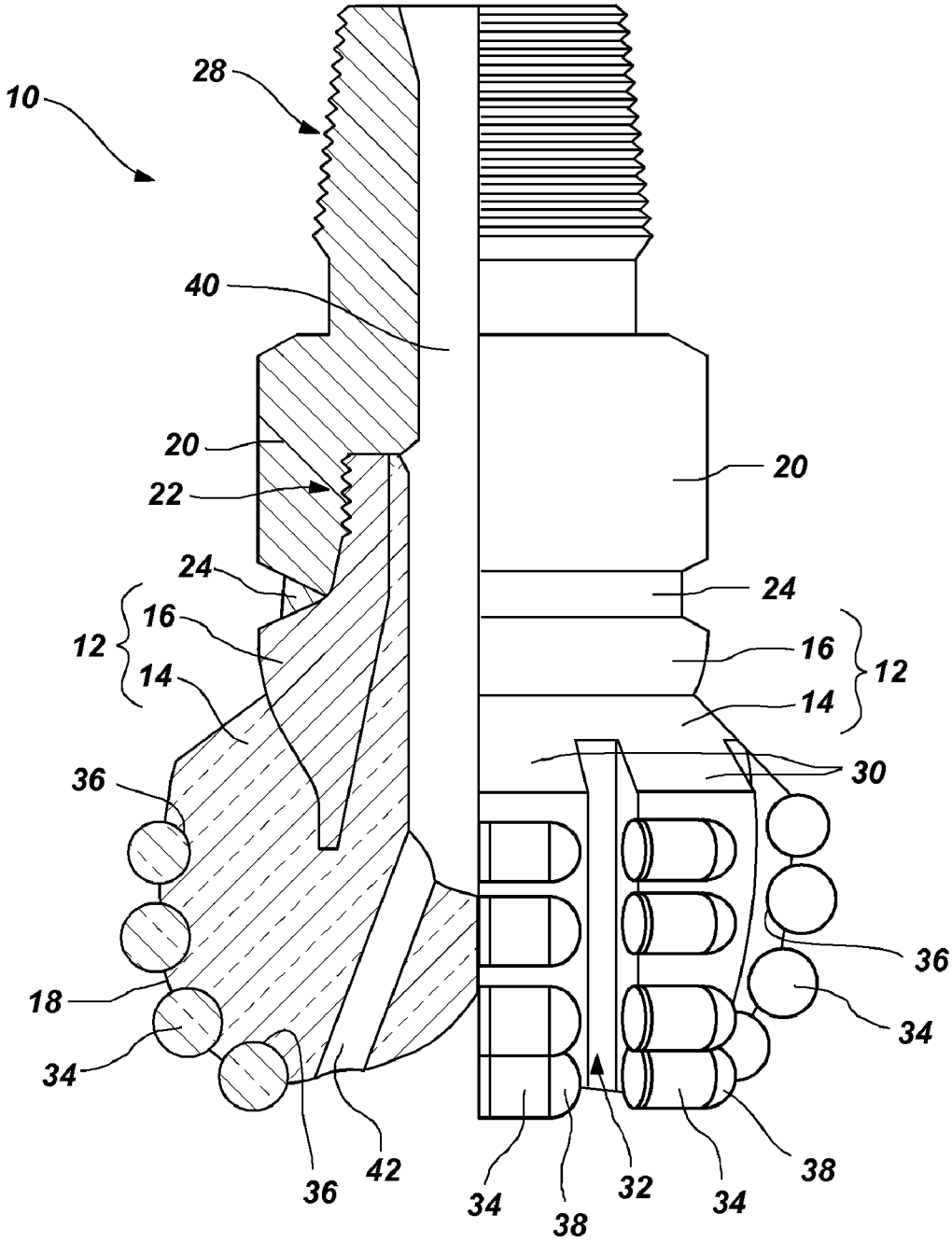
FIG. 1 (PRIOR ART)
FIG. 1 is a partial cross-sectional side view of a conventional earth-boring rotary drill bit having a bit body that includes a particle-matrix composite material.
Figure 2:
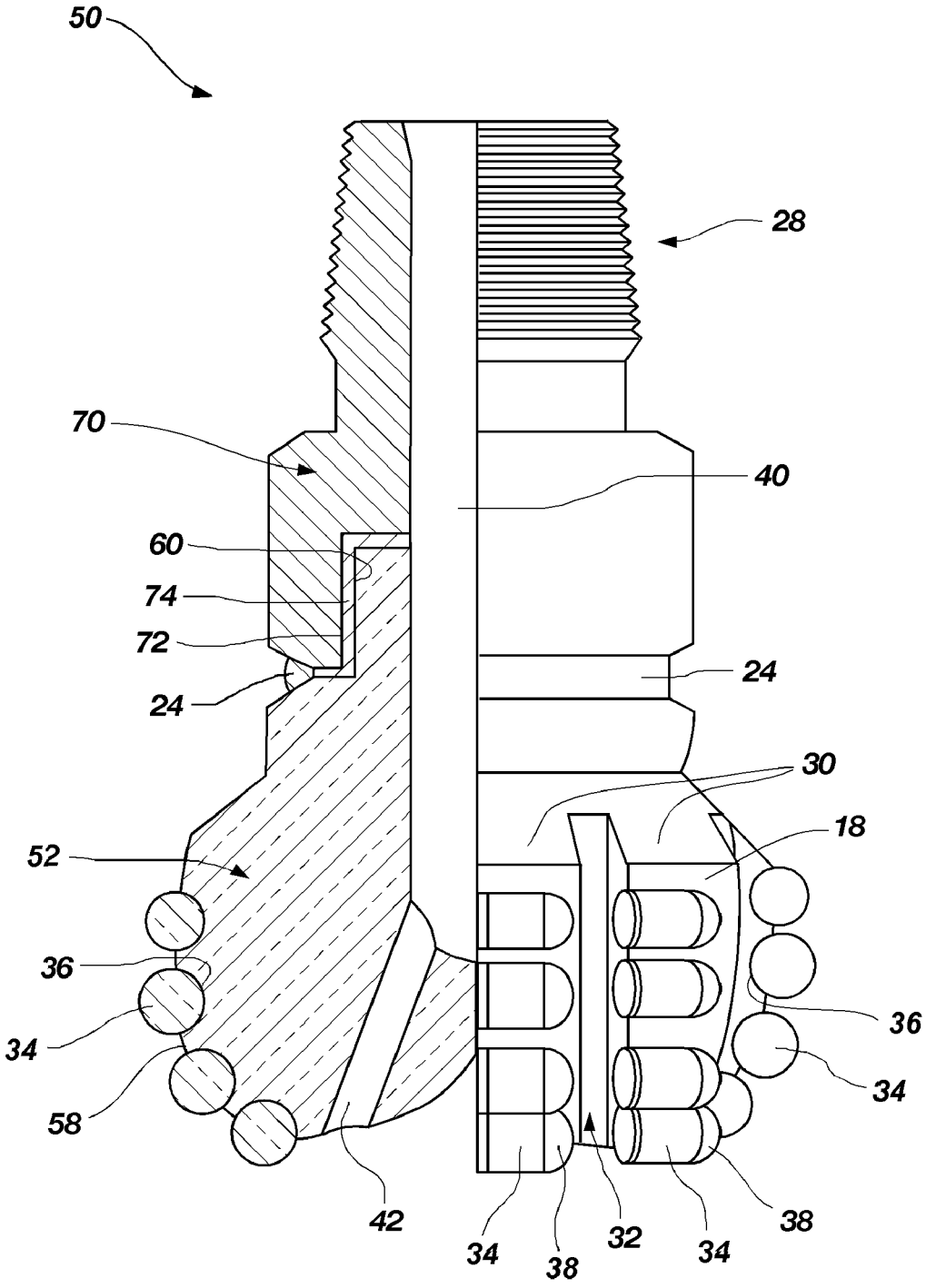
FIG. 2 is a partial cross-sectional side view of an earth-boring rotary drill bit that embodies teachings of the present invention and has a bit body that includes a particle-matrix composite material.

An earth-boring rotary drill bit 50 that embodies teachings of the present invention is shown in FIG. 2. The drill bit 50 includes a bit body 52 substantially formed from and composed of a particle-matrix composite material. The drill bit 50 also may include a shank 70 attached to the bit body 52. The bit body 52 does not include a steel blank integrally formed therewith for attaching the bit body 52 to the shank 70.

The bit body 52 includes blades 30, which are separated by junk slots 32. Internal fluid passageways 42 extend between the face 58 of the bit body 52 and a longitudinal bore 40, which extends through the shank 70 and partially through the bit body 52. The internal fluid passageways 42 may have a substantially linear, piece-wise linear, or curved configuration. Nozzle inserts (not shown) or fluid ports may be provided at face 58 of the bit body 52 within the internal fluid passageways 42. The nozzle inserts may be integrally formed with the bit body 52 and may include circular or noncircular cross sections at the openings at the face 58 of the bit body 52.

The drill bit 50 may include a plurality of PDC cutters 34 disposed on the face 58 of the bit body 52. The PDC cutters 34 may be provided along blades 30 within pockets 36 formed in the face 58 of the bit body 52, and may be supported from behind by buttresses 38, which may be integrally formed with the bit body 52. Alternatively, the drill bit 50 may include a plurality of cutters formed from an abrasive, wear-resistant material such as, for example, cemented tungsten carbide. Furthermore, the cutters may be integrally formed with the bit body 52, as will be discussed in further detail below.

The particle-matrix composite material of the bit body 52 may include a plurality of hard particles randomly dispersed throughout a matrix material. The hard particles may comprise diamond or ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide, titanium carbide (TiC), tantalum carbide (TaC), titanium diboride ($TiB_2$), chromium carbides, titanium nitride (TiN), aluminium oxide ($Al_2O_3$), aluminium nitride (AlN), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art.

The matrix material of the particle-matrix composite material may include, for example, cobalt-based, iron-based, nickel-based, iron and nickel-based, cobalt and nickel-based, iron and cobalt-based, aluminum-based, copper-based, magnesium-based, and titanium-based alloys. The matrix material may also be selected from commercially pure elements such as cobalt, aluminum, copper, magnesium, titanium, iron, and nickel. By way of example and not limitation, the matrix material may include carbon steel, alloy steel, stainless steel, tool steel, Hadfield manganese steel, nickel or cobalt superalloy material, and low thermal expansion iron or nickel-based alloys such as INVAR®. As used herein, the term "superalloy" refers to an iron, nickel, and cobalt-based alloy having at least 12% chromium by weight. Additional exemplary alloys that may be used as matrix material include austenitic steels, nickel-based superalloys such as INCONEL® 625M or RENE® 95, and INVAR® type alloys having a coefficient of thermal expansion that closely matches that of the hard particles used in the particular particle-matrix composite material. More closely matching the coefficient of thermal expansion of matrix material with that of the hard particles offers advantages such as reducing problems associated with residual stresses and thermal fatigue. Another exemplary matrix material is a Hadfield austenitic manganese steel (Fe with approximately 12% Mn by weight and 1.1% C by weight).

In one embodiment of the present invention, the particle-matrix composite material may include a plurality of −400 ASTM (American Society for Testing and Materials) mesh tungsten carbide particles. For example, the tungsten carbide particles may be substantially composed of WC. As used herein, the phrase "−400 ASTM mesh particles" means particles that pass through an ASTM No. 400 mesh screen as defined in ASTM specification E11-04 entitled Standard Specification for Wire Cloth and Sieves for Testing Purposes. Such tungsten carbide particles may have a diameter of less than about 38 microns. The matrix material may include a metal alloy comprising about 50% cobalt by weight and about 50% nickel by weight. The tungsten carbide particles may comprise between about 60% and about 95% by weight of the particle-matrix composite material, and the matrix material may comprise between about 5% and about 40% by weight of the particle-matrix composite material. More particularly, the tungsten carbide particles may comprise between about 70% and about 80% by weight of the particle-matrix composite material, and the matrix material may comprise between about 20% and about 30% by weight of the particle-matrix composite material.

In another embodiment of the present invention, the particle-matrix composite material may include a plurality of −635 ASTM mesh tungsten carbide particles. As used herein, the phrase "−635 ASTM mesh particles" means particles that pass through an ASTM No. 635 mesh screen as defined in ASTM specification E11-04 entitled Standard Specification for Wire Cloth and Sieves for Testing Purposes. Such tungsten carbide particles may have a diameter of less than about 20 microns. The matrix material may include a cobalt-based metal alloy comprising substantially commercially pure cobalt. For example, the matrix material may include greater than about 98% cobalt by weight. The tungsten carbide particles may comprise between about 60% and about 95% by weight of the particle-matrix composite material, and the matrix material may comprise between about 5% and about 40% by weight of the particle-matrix composite material.

With continued reference to FIG. 2, the shank 70 includes a male or female API threaded connection portion for connecting the drill bit 50 to a drill string (not shown). The shank 70 may be formed from and composed of a material that is relatively tough and ductile relative to the bit body 52. By way of example and not limitation, the shank 70 may include a steel alloy.

As the particle-matrix composite material of the bit body 52 may be relatively wear-resistant and abrasive, machining of the bit body 52 may be difficult or impractical. As a result, conventional methods for attaching the shank 70 to the bit body 52, such as by machining cooperating positioning threads on mating surfaces of the bit body 52 and the shank 70, with subsequent formation of a weld 24, may not be feasible.

As an alternative to conventional methods for attaching the shank 70 to the bit body 52, the bit body 52 may be attached and secured to the shank 70 by brazing or soldering an interface between abutting surfaces of the bit body 52 and the shank 70. By way of example and not limitation, a brazing alloy 74 may be provided at an interface between a surface 60 of the bit body 52 and a surface 72 of the shank 70. Furthermore, the bit body 52 and the shank 70 may be sized and configured to provide a predetermined standoff between the surface 60 and the surface 72, in which the brazing alloy 74 may be provided.

Alternatively, the shank 70 may be attached to the bit body 52 using a weld 24 provided between the bit body 52 and the shank 70. The weld 24 may extend around the drill bit 50 on an exterior surface thereof along an interface between the bit body 52 and the shank 70.

In alternative embodiments, the bit body 52 and the shank 70 may be sized and configured to provide a press fit or a shrink fit between the surface 60 and the surface 72 to attach the shank 70 to the bit body 52.

Furthermore, interfering non-planar surface features may be formed on the surface 60 of the bit body 52 and the surface 72 of the shank 70. For example, threads or longitudinally extending splines, rods, or keys (not shown) may be provided in or on the surface 60 of the bit body 52 and the surface 72 of the shank 70 to prevent rotation of the bit body 52 relative to the shank 70.

FIGS. 3A-3E illustrate a method of forming the bit body 52, which is substantially formed from and composed of a particle-matrix composite material. The method generally includes providing a powder mixture, pressing the powder mixture to form a green body, and at least partially sintering the powder mixture.

Figure 3A:
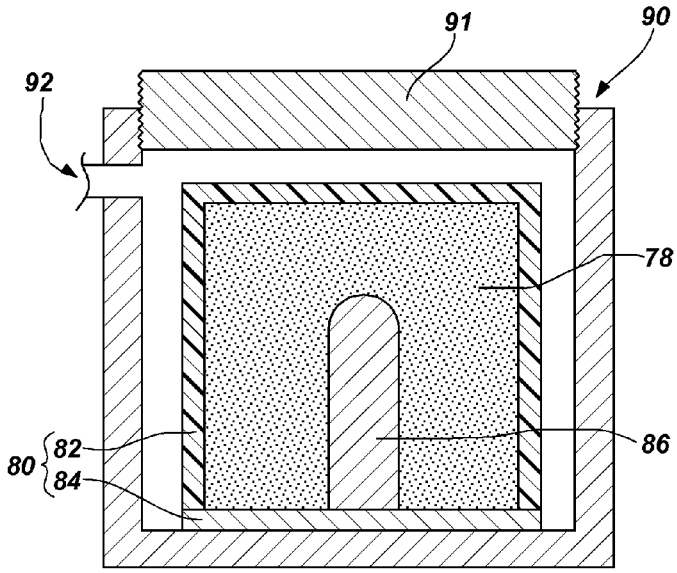
FIGS. 3A-3E illustrate a method of forming the bit body of the earth-boring rotary drill bit shown in FIG. 2.

Referring to FIG. 3A, a powder mixture 78 may be pressed with substantially isostatic pressure within a mold or container 80. The powder mixture 78 may include a plurality of the previously described hard particles and a plurality of particles comprising a matrix material, as also previously described herein. Optionally, the powder mixture 78 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The container 80 may include a fluid-tight deformable member 82. For example, the fluid-tight deformable member 82 may be a substantially cylindrical bag comprising a deformable polymer material. The container 80 may further include a sealing plate 84, which may be substantially rigid. The deformable member 82 may be formed from, for example, an elastomer such as rubber, neoprene, silicone, or polyurethane. The deformable member 82 may be filled with the powder mixture 78 and vibrated to provide a uniform distribution of the powder mixture 78 within the deformable member 82. At least one displacement or insert 86 may be provided within the deformable member 82 for defining features of the bit body 52 such as, for example, the longitudinal bore 40 (FIG. 2). Alternatively, the insert 86 may not be used and the longitudinal bore 40 may be formed using a conventional machining process during subsequent processes. The sealing plate 84 then may be attached or bonded to the deformable member 82 providing a fluid-tight seal therebetween.

The container 80 (with the powder mixture 78 and any desired inserts 86 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 at high pressures using a pump (not shown). The high pressure of the fluid causes the walls of the deformable member 82 to deform. The fluid pressure may be transmitted substantially uniformly to the powder mixture 78. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascals (20,000 pounds per square inch). In alternative methods, a vacuum may be provided within the container 80 and a pressure greater than about 0.1 megapascal (about 15 pounds per square inch) may be applied to the exterior surfaces of the container (by, for example, the atmosphere) to compact the powder mixture 78. Isostatic pressing of the powder mixture 78 may form a green powder component or green bit body 94 shown in FIG. 3B, which can be removed from the pressure chamber 90 and container 80 after pressing.

Figure 3B:
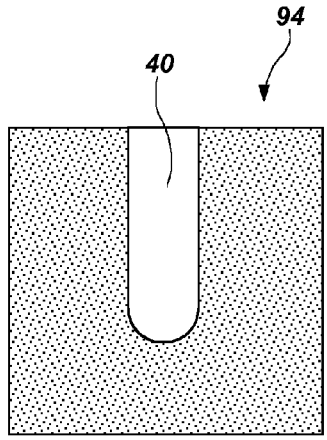

In an alternative method of pressing the powder mixture 78 to form the green bit body 94 shown in FIG. 3B, the powder mixture 78 may be uniaxially pressed in a mold or die (not shown) using a mechanically or hydraulically actuated plunger by methods that are known to those of ordinary skill in the art of powder processing.

The green bit body 94 shown in FIG. 3B may include a plurality of particles (hard particles and particles of matrix material) held together by a binder material provided in the powder mixture 78 (FIG. 3A), as previously described. Certain structural features may be machined in the green bit body 94 using conventional machining techniques including, for example, turning techniques, milling techniques, and drilling techniques. Hand held tools also may be used to manually form or shape features in or on the green bit body 94. By way of example and not limitation, blades 30, junk slots 32, and surface 60 (FIG. 2) may be machined or otherwise formed in the green bit body 94 to form a shaped green bit body 98 shown in FIG. 3C.

Figure 3C:
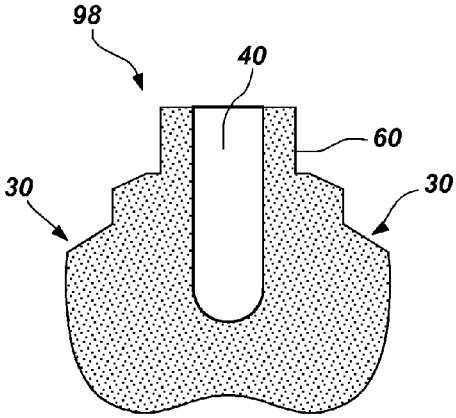
Figure 3D:
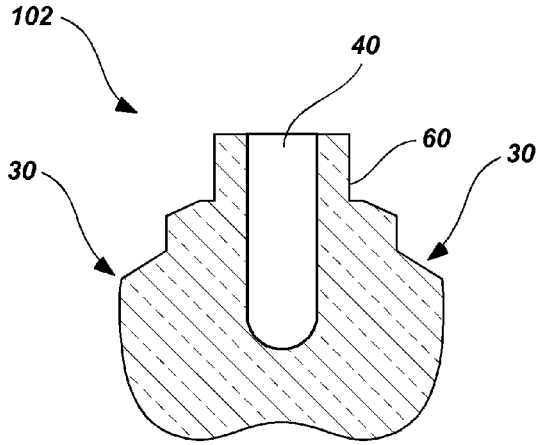

The shaped green bit body 98 shown in FIG. 3C may be at least partially sintered to provide a brown bit body 102 shown in FIG. 3D, which has less than a desired final density. Prior to partially sintering the shaped green bit body 98, the shaped green bit body 98 may be subjected to moderately elevated temperatures and pressures to burn off or remove any fugitive additives that were included in the powder mixture 78 (FIG. 3A), as previously described. Furthermore, the shaped green bit body 98 may be subjected to a suitable atmosphere tailored to aid in the removal of such additives. Such atmospheres may include, for example, hydrogen gas at temperatures of about 500° C.

The brown bit body 102 may be substantially machinable due to the remaining porosity therein. Certain structural features may be machined in the brown bit body 102 using conventional machining techniques including, for example, turning techniques, milling techniques, and drilling techniques. Hand held tools also may be used to manually form or shape features in or on the brown bit body 102. Tools that include super hard coatings or inserts may be used to facilitate machining of the brown bit body 102. Additionally, material coatings may be applied to surfaces of the brown bit body 102 that are to be machined to reduce chipping of the brown bit body 102. Such coatings may include a fixative or other polymer material.

Figure 3E:
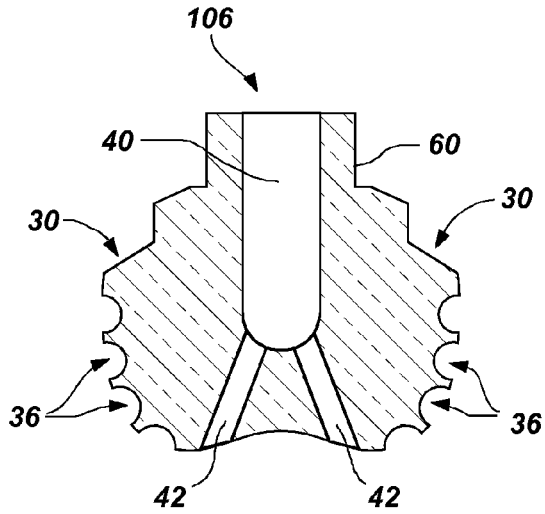

By way of example and not limitation, internal fluid passageways 42, cutter pockets 36, and buttresses 38 (FIG. 2) may be machined or otherwise formed in the brown bit body 102 to form a shaped brown bit body 106 shown in FIG. 3E. Furthermore, if the drill bit 50 is to include a plurality of cutters integrally formed with the bit body 52, the cutters may be positioned within the cutter pockets 36 formed in the brown bit body 102. Upon subsequent sintering of the brown bit body 102, the cutters may become bonded to and integrally formed with the bit body 52.

The shaped brown bit body 106 shown in FIG. 3E then may be fully sintered to a desired final density to provide the previously described bit body 52 shown in FIG. 2. As sintering involves densification and removal of porosity within a structure, the structure being sintered will shrink during the sintering process. A structure may experience linear shrinkage of between 10% and 20% during sintering from a green state to a desired final density. As a result, dimensional shrinkage must be considered and accounted for when designing tooling (molds, dies, etc.) or machining features in structures that are less than fully sintered.

During all sintering and partial sintering processes, refractory structures or displacements (not shown) may be used to support at least portions of the bit body during the sintering process to maintain desired shapes and dimensions during the densification process. Such displacements may be used, for example, to maintain consistency in the size and geometry of the cutter pockets 36 and the internal fluid passageways 42 during the sintering process. Such refractory structures may be formed from, for example, graphite, silica, or alumina. The use of alumina displacements instead of graphite displacements may be desirable as alumina may be relatively less reactive than graphite, thereby minimizing atomic diffusion during sintering. Additionally, coatings such as alumina, boron nitride, aluminum nitride, or other commercially available materials may be applied to the refractory structures to prevent carbon or other atoms in the refractory structures from diffusing into the bit body during densification.

In alternative methods, the green bit body 94 shown in FIG. 3B may be partially sintered to form a brown bit body without prior machining, and all necessary machining may be performed on the brown bit body prior to fully sintering the brown bit body to a desired final density. Alternatively, all necessary machining may be performed on the green bit body 94 shown in FIG. 3B, which then may be fully sintered to a desired final density.

The sintering processes described herein may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes described herein may include subliquidus phase sintering. In other words, the sintering processes may be conducted at temperatures proximate to but below the liquidus line of the phase diagram for the matrix material. For example, the sintering processes described herein may be conducted using a number of different methods known to one of ordinary skill in the art such as the Rapid Omnidirectional Compaction (ROC) process, the CERACON™ process, hot isostatic pressing (HIP), or adaptations of such processes.

Broadly, and by way of example only, sintering a green powder compact using the ROC process involves presintering the green powder compact at a relatively low temperature to only a sufficient degree to develop sufficient strength to permit handling of the powder compact. The resulting brown structure is wrapped in a material such as graphite foil to seal the brown structure. The wrapped brown structure is placed in a container, which is filled with particles of a ceramic, polymer, or glass material having a substantially lower melting point than that of the matrix material in the brown structure. The container is heated to the desired sintering temperature, which is above the melting temperature of the particles of a ceramic, polymer, or glass material, but below the liquidus temperature of the matrix material in the brown structure. The heated container with the molten ceramic, polymer, or glass material (and the brown structure immersed therein) is placed in a mechanical or hydraulic press, such as a forging press, that is used to apply pressure to the molten ceramic or polymer material. Isostatic pressures within the molten ceramic, polymer, or glass material facilitate consolidation and sintering of the brown structure at the elevated temperatures within the container. The molten ceramic, polymer, or glass material acts to transmit the pressure and heat to the brown structure. In this manner, the molten ceramic, polymer, or glass acts as a pressure transmission medium through which pressure is applied to the structure during sintering. Subsequent to the release of pressure and cooling, the sintered structure is then removed from the ceramic, polymer, or glass material. A more detailed explanation of the ROC process and suitable equipment for the practice thereof is provided by U.S. Pat. Nos. 4,094,709, 4,233,720, 4,341,557, 4,526,748, 4,547,337, 4,562,990, 4,596,694, 4,597,730, 4,656,002 4,744,943 and 5,232,522, the disclosure of each of which patents is incorporated herein by reference.

The CERACON™ process, which is similar to the aforementioned ROC process, may also be adapted for use in the present invention to fully sinter brown structures to a final density. In the CERACON™ process, the brown structure is coated with a ceramic coating such as alumina, zirconium oxide, or chrome oxide. Other similar, hard, generally inert, protective, removable coatings may also be used. The coated brown structure is fully consolidated by transmitting at least substantially isostatic pressure to the coated brown structure using ceramic particles instead of a fluid media as in the ROC process. A more detailed explanation of the CERACON™ process is provided by U.S. Pat. No. 4,499,048, the disclosure of which patent is incorporated herein by reference.

Furthermore, in embodiments of the invention in which tungsten carbide is used in a particle-matrix composite bit body, the sintering processes described herein also may include a carbon control cycle tailored to improve the stoichiometry of the tungsten carbide material. By way of example and not limitation, if the tungsten carbide material includes WC, the sintering processes described herein may include subjecting the tungsten carbide material to a gaseous mixture including hydrogen and methane at elevated temperatures. For example, the tungsten carbide material may be subjected to a flow of gases including hydrogen and methane at a temperature of about 1,000° C.

As previously discussed, several different methods may be used to attach the shank 70 to the bit body 52. In the embodiment shown in FIG. 2, the shank 70 may be attached to the bit body 52 by brazing or soldering the interface between the surface 60 of the bit body 52 and the surface 72 of the shank 70. The bit body 52 and the shank 70 may be sized and configured to provide a predetermined standoff between the surface 60 and the surface 72, in which the brazing alloy 74 may be provided. Furthermore, the brazing alloy 74 may be applied to the interface between the surface 60 of the bit body 52 and the surface 72 of the shank 70 using a furnace brazing process or a torch brazing process. The brazing alloy 74 may include, for example, a silver-based or a nickel-based alloy.

As previously mentioned, a shrink fit may be provided between the shank 70 and the bit body 52 in alternative embodiments of the invention. By way of example and not limitation, the shank 70 may be heated to cause thermal expansion of the shank 70, while the bit body 52 is cooled to cause thermal contraction of the bit body 52. The shank 70 then may be pressed onto the bit body 52 and the temperatures of the shank 70 and the bit body 52 may be allowed to equilibrate. As the temperatures of the shank 70 and the bit body 52 equilibrate, the surface 72 of the shank 70 may engage or abut against the surface 60 of the bit body 52, thereby at least partly securing the bit body 52 to the shank 70 and preventing separation of the bit body 52 from the shank 70.

Alternatively, a friction weld may be provided between the bit body 52 and the shank 70. Mating surfaces may be provided on the shank 70 and the bit body 52. A machine may be used to press the shank 70 against the bit body 52 while rotating the bit body 52 relative to the shank 70. Heat generated by friction between the shank 70 and the bit body 52 may at least partially melt the material at the mating surfaces of the shank 70 and the bit body 52. The relative rotation may be stopped and the bit body 52 and the shank 70 may be allowed to cool while maintaining axial compression between the bit body 52 and the shank 70, providing a friction welded interface between the mating surfaces of the shank 70 and the bit body 52.

Commercially available adhesives such as, for example, epoxy materials (including inter-penetrating network (IPN) epoxies), polyester materials, cyanacrylate materials, polyurethane materials, and polyimide materials may also be used to secure the shank 70 to the bit body 52.

As previously described, a weld 24 may be provided between the bit body 52 and the shank 70 that extends around the drill bit 50 on an exterior surface thereof along an interface between the bit body 52 and the shank 70. A shielded metal arc welding (SMAW) process, a gas metal arc welding (GMAW) process, a plasma transferred arc (PTA) welding process, a submerged arc welding process, an electron beam welding process, or a laser beam welding process may be used to weld the interface between the bit body 52 and the shank 70. Furthermore, the interface between the bit body 52 and the shank 70 may be soldered or brazed using processes known in the art to further secure the bit body 52 to the shank 70.

Referring again to FIG. 2, wear-resistant hardfacing materials (not shown) may be applied to selected surfaces of the bit body 52 and/or the shank 70. For example, hardfacing materials may be applied to selected areas on exterior surfaces of the bit body 52 and the shank 70, as well as to selected areas on interior surfaces of the bit body 52 and the shank 70 that are susceptible to erosion, such as, for example, surfaces within the internal fluid passageways 42. Such hardfacing materials may include a particle-matrix composite material, which may include, for example, particles of tungsten carbide dispersed throughout a continuous matrix material. Conventional flame spray techniques may be used to apply such hardfacing materials to surfaces of the bit body 52 and/or the shank 70. Known welding techniques such as oxy-acetylene, metal inert gas (MIG), tungsten inert gas (TIG), and plasma transferred arc welding (PTAW) techniques also may be used to apply hardfacing materials to surfaces of the bit body 52 and/or the shank 70.

Cold spray techniques provide another method by which hardfacing materials may be applied to surfaces of the bit body 52 and/or the shank 70. In cold spray techniques, energy stored in high pressure compressed gas is used to propel fine powder particles at very high velocities (500 to 1500 m/s) at the substrate. Compressed gas is fed through a heating unit to a gun where the gas exits through a specially designed nozzle at very high velocity. Compressed gas is also fed via a high pressure powder feeder to introduce the powder material into the high velocity gas jet. The powder particles are moderately heated and accelerated to a high velocity toward the substrate. On impact the particles deform and bond to form a coating of hardfacing material.

Yet another technique for applying hardfacing material to selected surfaces of the bit body 52 and/or the shank 70 involves applying a first cloth or fabric comprising a carbide material to selected surfaces of the bit body 52 and/or the shank 70 using a low temperature adhesive, applying a second layer of cloth or fabric containing brazing or matrix material over the fabric of carbide material, and heating the resulting structure in a furnace to a temperature above the melting point of the matrix material. The molten matrix material is wicked into the tungsten carbide cloth, metallurgically bonding the tungsten carbide cloth to the bit body 52 and/or the shank 70 and forming the hardfacing material. Alternatively, a single cloth that includes a carbide material and a brazing or matrix material may be used to apply hardfacing material to selected surfaces of the bit body 52 and/or the shank 70. Such cloths and fabrics are commercially available from, for example, Conforma Clad, Inc. of New Albany, Ind.

Conformable sheets of hardfacing material that include diamond may also be applied to selected surfaces of the bit body 52 and/or the shank 70.

Figure 4:
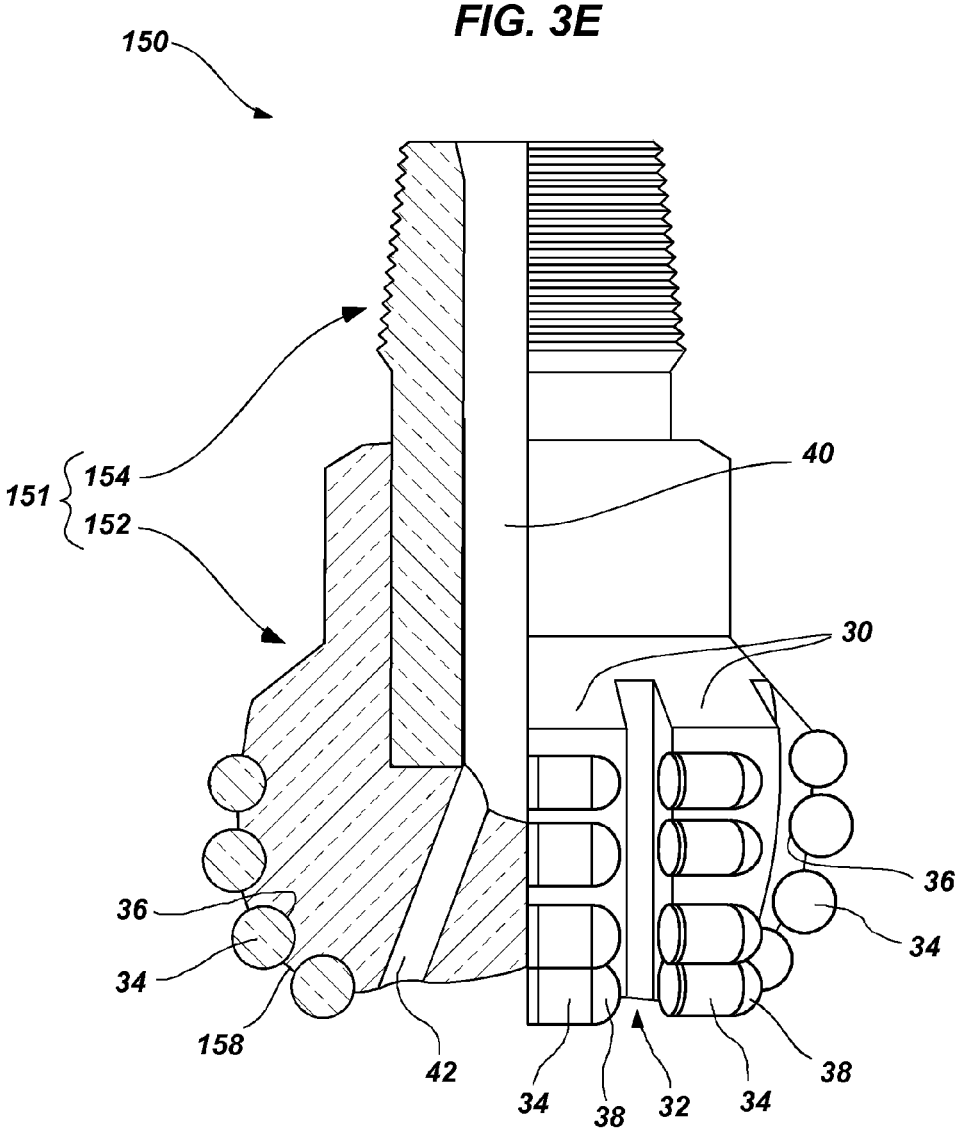
FIG. 4 is a partial cross-sectional side view of another earth-boring rotary drill bit that embodies teachings of the present invention and has a bit body that includes a particle-matrix composite material.

Another earth-boring rotary drill bit 150 that embodies teachings of the present invention is shown in FIG. 4. The drill bit 150 includes a unitary structure 151 that includes a bit body 152 and a threaded pin 154. The unitary structure 151 is substantially formed from and composed of a particle-matrix composite material. In this configuration, it may not be necessary to use a separate shank to attach the drill bit 150 to a drill string.

The bit body 152 includes blades 30, which are separated by junk slots 32. Internal fluid passageways 42 extend between the face 158 of the bit body 152 and a longitudinal bore 40, which at least partially extends through the unitary structure 151. Nozzle inserts (not shown) may be provided at face 158 of the bit body 152 within the internal fluid passageways 42.

The drill bit 150 may include a plurality of PDC cutters 34 disposed on the face 158 of the bit body 152. The PDC cutters 34 may be provided along blades 30 within pockets 36 formed in the face 158 of the bit body 152, and may be supported from behind by buttresses 38, which may be integrally formed with the bit body 152. Alternatively, the drill bit 150 may include a plurality of cutters each comprising an abrasive, wear-resistant material such as, for example, cemented tungsten carbide.

The unitary structure 151 may include a plurality of regions. Each region may comprise a particle-matrix composite material having a material composition that differs from other regions of the plurality of regions. For example, the bit body 152 may include a particle-matrix composite material having a first material composition, and the threaded pin 154 may include a particle-matrix composite material having a second material composition that is different from the first material composition. In this configuration, the material composition of the bit body 152 may exhibit a physical property that differs from a physical property exhibited by the material composition of the threaded pin 154. For example, the first material composition may exhibit higher erosion and wear-resistance relative to the second material composition, and the second material composition may exhibit higher fracture toughness relative to the first material composition.

In one embodiment of the present invention, the particle-matrix composite material of the bit body 152 (the first composition) may include a plurality of −635 ASTM mesh tungsten carbide particles. More particularly, the particle-matrix composite material of the bit body 152 (the first composition) may include a plurality of tungsten carbide particles having an average diameter in a range from about 0.5 micron to about 20 microns. The matrix material of the first composition may include a cobalt-based metal alloy comprising greater than about 98% cobalt by weight. The tungsten carbide particles may comprise between about 75% and about 85% by weight of the first composition of particle-matrix composite material, and the matrix material may comprise between about 15% and about 25% by weight of the first composition of particle-matrix composite material. The particle-matrix composite material of the threaded pin 154 (the second composition) may include a plurality of −635 ASTM mesh tungsten carbide particles. More particularly, the particle-matrix composite material of the threaded pin 154 may include a plurality of tungsten carbide particles having an average diameter in a range from about 0.5 micron to about 20 microns. The matrix material of the second composition may include a cobalt-based metal alloy comprising greater than about 98% cobalt by weight. The tungsten carbide particles may comprise between about 65% and about 70% by weight of the second composition of particle-matrix composite material, and the matrix material may comprise between about 30% and about 35% by weight of the second composition of particle-matrix composite material.

The drill bit 150 shown in FIG. 4 includes two distinct regions, each of which comprises a particle-matrix composite material having a unique material composition. In alternative embodiments, the drill bit 150 may include three or more different regions, each having a unique material composition. Furthermore, a discrete boundary is identifiable between the two distinct regions of the drill bit 150 shown in FIG. 4. In alternative embodiments, a continuous material composition gradient may be provided throughout the unitary structure 151 to provide a drill bit having a plurality of different regions, each having a unique material composition, but lacking any identifiable boundaries between the various regions. In this manner, the physical properties and characteristics of different regions within the drill bit 150 may be tailored to improve properties such as, for example, wear-resistance, fracture toughness, strength, or weldability in strategic regions of the drill bit 150. It is understood that the various regions of the drill bit may have material compositions that are selected or tailored to exhibit any desired particular physical property or characteristic, and the present invention is not limited to selecting or tailing the material compositions of the regions to exhibit the particular physical properties or characteristics described herein.

One method that may be used to form the drill bit 150 shown in FIG. 4 will now be described with reference to FIGS. 5A-5K. The method involves separately forming the bit body 152 and the threaded pin 154 in the brown state, assembling the bit body 152 with the threaded pin 154 in the brown state to provide the unitary structure 151, and sintering the unitary structure 151 to a desired final density. The bit body 152 is bonded and secured to the threaded pin 154 during the sintering process.

Figure 5A:
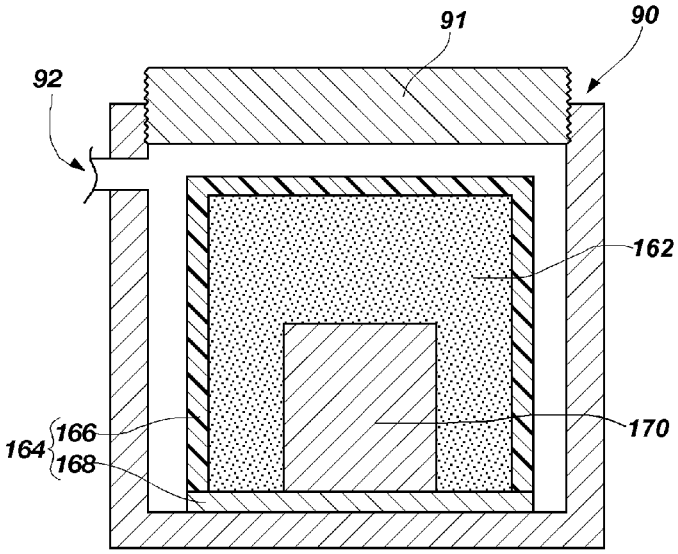
FIGS. 5A-5K illustrate a method of forming the earth-boring rotary drill bit shown in FIG. 4.

Referring to FIGS. 5A-5E, the bit body 152 may be formed in the green state using an isostatic pressing process. As shown in FIG. 5A, a powder mixture 162 may be pressed with substantially isostatic pressure within a mold or container 164. The powder mixture 162 may include a plurality of hard particles and a plurality of particles comprising a matrix material. The hard particles and the matrix material may be substantially identical to those previously discussed in relation to the drill bit 50 shown in FIG. 2. Optionally, the powder mixture 162 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The container 164 may include a fluid-tight deformable member 166 and a sealing plate 168. For example, the fluid-tight deformable member 166 may be a substantially cylindrical bag comprising a deformable polymer material. The deformable member 166 may be formed from, for example, a deformable polymer material. The deformable member 166 may be filled with the powder mixture 162. The deformable member 166 and the powder mixture 162 may be vibrated to provide a uniform distribution of the powder mixture 162 within the deformable member 166. At least one displacement or insert 170 may be provided within the deformable member 166 for defining features such as, for example, the longitudinal bore 40 (FIG. 4). Alternatively, the insert 170 may not be used and the longitudinal bore 40 may be formed using a conventional machining process during subsequent processes. The sealing plate 168 then may be attached or bonded to the deformable member 166 providing a fluid-tight seal therebetween.

The container 164 (with the powder mixture 162 and any desired inserts 170 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 using a pump (not shown). The high pressure of the fluid causes the walls of the deformable member 166 to deform. The pressure may be transmitted substantially uniformly to the powder mixture 162. The pressure within the pressure chamber during isostatic pressing may be greater than about 35 megapascals (about 5,000 pounds per square inch). More particularly, the pressure within the pressure chamber during isostatic pressing may be greater than about 138 megapascals (20,000 pounds per square inch). In alternative methods, a vacuum may be provided within the container 164 and a pressure greater than about 0.1 megapascal (about 15 pounds per square inch) may be applied to the exterior surfaces of the container 164 (by, for example, the atmosphere) to compact the powder mixture 162. Isostatic pressing of the powder mixture 162 may form a green powder component or green bit body 174 shown in FIG. 5B, which can be removed from the pressure chamber 90 and container 164 after pressing.

Figure 5B:
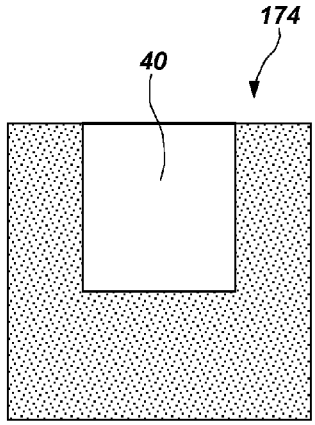

In an alternative method of pressing the powder mixture 162 to form the green bit body 174 shown in FIG. 5B, the powder mixture 162 may be uniaxially pressed in a mold or container (not shown) using a mechanically or hydraulically actuated plunger by methods that are known to those of ordinary skill in the art of powder processing.

The green bit body 174 shown in FIG. 5B may include a plurality of particles held together by binder materials provided in the powder mixture 162 (FIG. 5A). Certain structural features may be machined in the green bit body 174 using conventional machining techniques including, for example, turning techniques, milling techniques, and drilling techniques. Hand held tools also may be used to manually form or shape features in or on the green bit body 174.

Figure 5C:
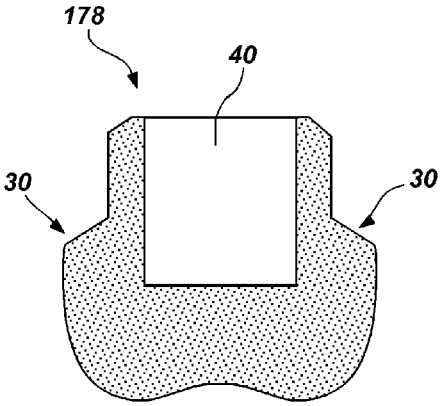

By way of example and not limitation, blades 30, junk slots 32 (FIG. 4), and any other features may be formed in the green bit body 174 to form a shaped green bit body 178 shown in FIG. 5C.

Figure 5D:
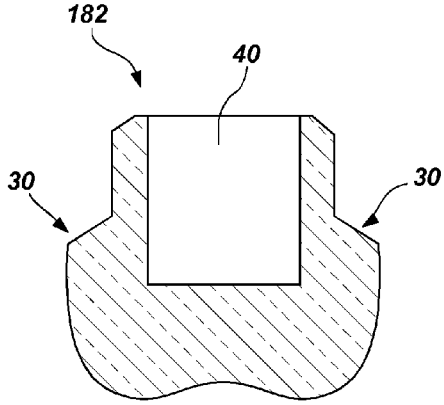

The shaped green bit body 178 shown in FIG. 5C may be at least partially sintered to provide a brown bit body 182 shown in FIG. 5D, which has less than a desired final density. Prior to sintering, the shaped green bit body 178 may be subjected to elevated temperatures to burn off or remove any fugitive additives that were included in the powder mixture 162 (FIG. 5A) as previously described. Furthermore, the shaped green bit body 178 may be subjected to a suitable atmosphere tailored to aid in the removal of such additives. Such atmospheres may include, for example, hydrogen gas at temperatures of about 500° C.

The brown bit body 182 may be substantially machinable due to the remaining porosity therein. Certain structural features may be machined in the brown bit body 182 using conventional machining techniques including, for example, turning techniques, milling techniques, and drilling techniques. Hand held tools also may be used to manually form or shape features in or on the brown bit body 182. Furthermore, cutting tools that include super hard coatings or inserts may be used to facilitate machining of the brown bit body 182. Additionally, coatings may be applied to the brown bit body 182 prior to machining to reduce chipping of the brown bit body 182. Such coatings may include a fixative or other polymer material.

Figure 5E:
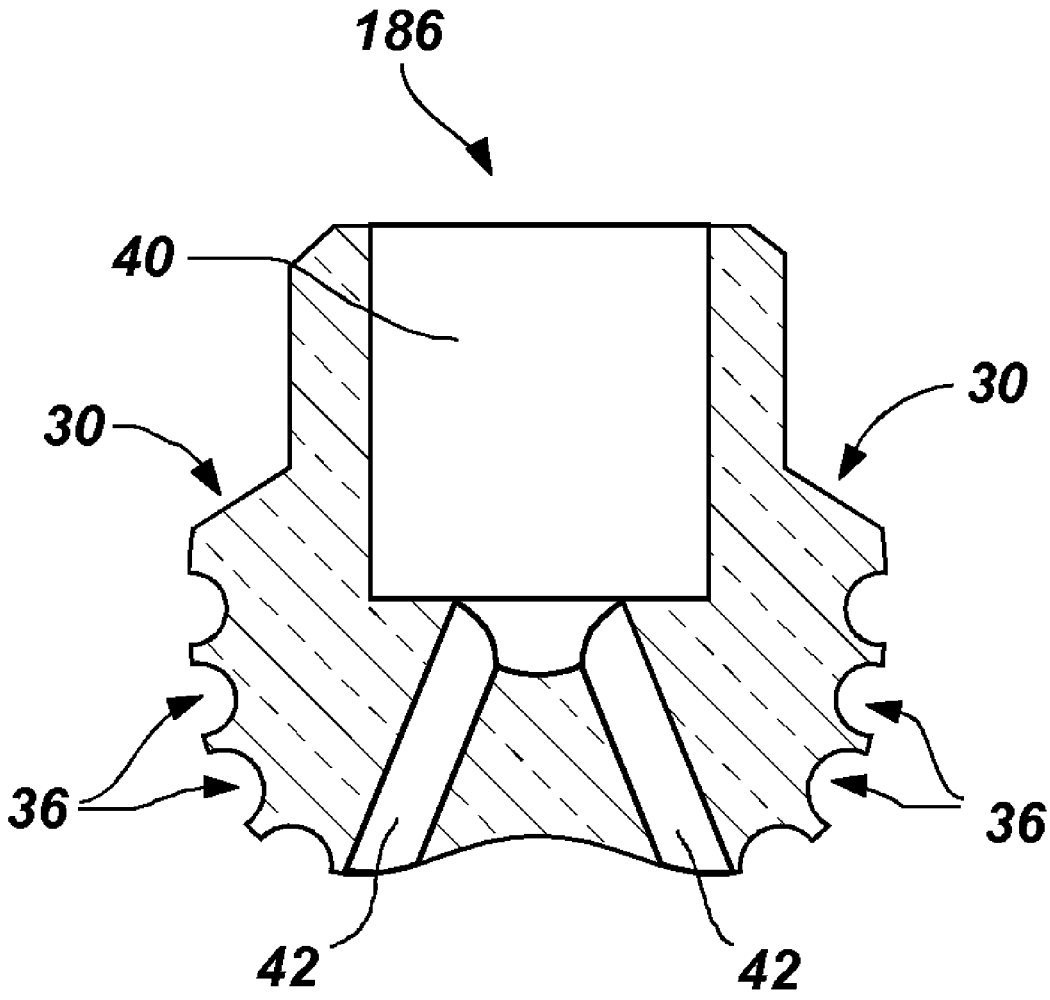

By way of example and not limitation, internal fluid passageways 42, cutter pockets 36, and buttresses 38 (FIG. 4) may be formed in the brown bit body 182 to form a shaped brown bit body 186 shown in FIG. 5E. Furthermore, if the drill bit 150 is to include a plurality of cutters integrally formed with the bit body 152, the cutters may be positioned within the cutter pockets 36 formed in the brown bit body 182. Upon subsequent sintering of the brown bit body 182, the cutters may become bonded to and integrally formed with the bit body 152.

Figure 5F:
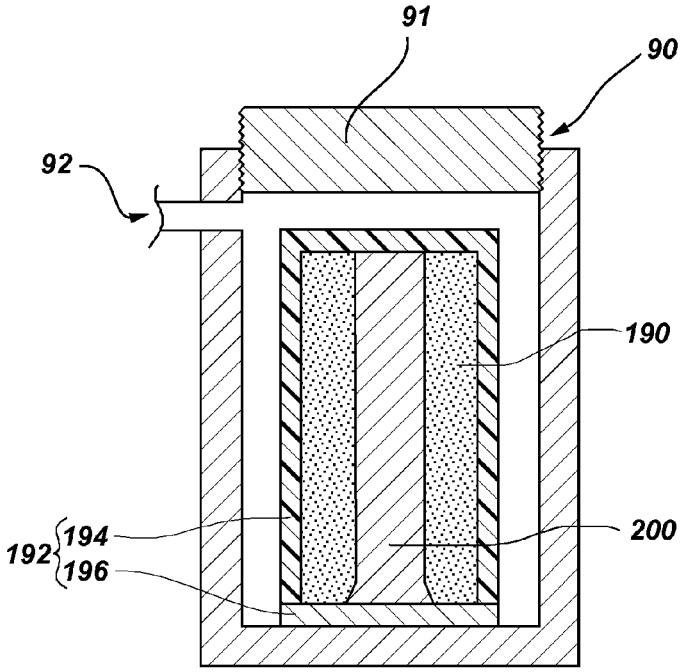

Referring to FIGS. 5F-5J, the threaded pin 154 may be formed in the green state using an isostatic pressing process substantially identical to that used to form the bit body 152. As shown in FIG. 5F, a powder mixture 190 may be pressed with substantially isostatic pressure within a mold or container 192. The powder mixture 190 may include a plurality of hard particles and a plurality of particles comprising a matrix material. The hard particles and the matrix material may be substantially identical to those previously discussed in relation to the drill bit 50 shown in FIG. 2. Optionally, the powder mixture 190 may further include additives commonly used when pressing powder mixtures, as previously described.

The container 192 may include a fluid-tight deformable member 194 and a sealing plate 196. The deformable member 194 may be formed from, for example, an elastomer such as rubber, neoprene, silicone, or polyurethane. The deformable member 194 may be filled with the powder mixture 190. The deformable member 194 and the powder mixture 190 may be vibrated to provide a uniform distribution of the powder mixture 190 within the deformable member 194. At least one displacement or insert 200 may be provided within the deformable member 194 for defining features such as, for example, the longitudinal bore 40 (FIG. 4). Alternatively, the insert 200 may not be used and the longitudinal bore 40 may be formed using a conventional machining process during subsequent processes. The sealing plate 196 then may be attached or bonded to the deformable member 194 providing a fluid-tight seal therebetween.

The container 192 (with the powder mixture 190 and any desired inserts 200 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 using a pump (not shown). The high pressure of the fluid causes the walls of the deformable member 194 to deform. The pressure may be transmitted substantially uniformly to the powder mixture 190. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascals (20,000 pounds per square inch). In alternative methods, a vacuum may be provided within the container 192 and a pressure greater than about 0.1 megapascal (about 15 pounds per square inch) may be applied to the exterior surfaces of the container 192 (by, for example, the atmosphere) to compact the powder mixture 190. Isostatic pressing of the powder mixture 190 may form a green powder component or green pin 204 shown in FIG. 5G, which can be removed from the pressure chamber 90 and container 192 after pressing.

Figure 5G:
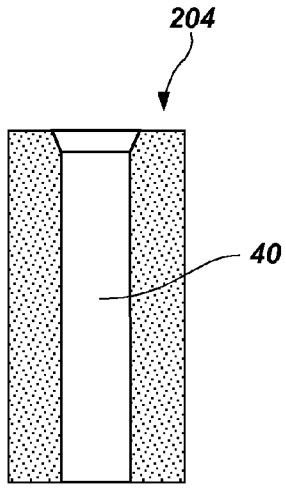

In an alternative method of pressing the powder mixture 190 to form the green pin 204 shown in FIG. 5G, the powder mixture 190 may be uniaxially pressed in a mold or container (not shown) using a mechanically or hydraulically actuated plunger by methods that are known to those of ordinary skill in the art of powder processing.

The green pin 204 shown in FIG. 5G may include a plurality of particles held together by binder materials provided in the powder mixture 190 (FIG. 5F). Certain structural features may be machined in the green pin 204 using conventional machining techniques including, for example, turning techniques, milling techniques, and drilling techniques. Hand held tools also may be used to manually form or shape features in or on the green pin 204 if necessary.

Figure 5H:
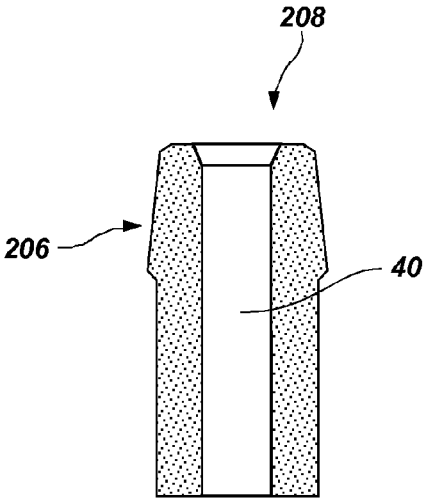
Figure 5I:
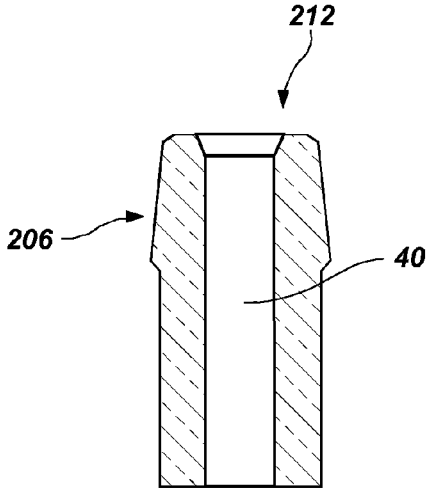

By way of example and not limitation, a tapered surface 206 may be formed on an exterior surface of the green pin 204 to form a shaped green pin 208 shown in FIG. 5H.

The shaped green pin 208 shown in FIG. 5H may be at least partially sintered at elevated temperatures in a furnace. For example, the shaped green pin 208 may be partially sintered to provide a brown pin 212 shown in FIG. 5I, which has less than a desired final density. Prior to sintering, the shaped green pin 208 may be subjected to elevated temperatures to burn off or remove any fugitive additives that were included in the powder mixture 190 (FIG. 5F) as previously described. Furthermore, the shaped green pin 208 may be subjected to a suitable atmosphere tailored to aid in the removal of such additives. Such atmospheres may include, for example, hydrogen gas at temperatures of about 500° C.

The brown pin 212 may be substantially machinable due to the remaining porosity therein. Certain structural features may be machined in the brown pin 212 using conventional machining techniques including, for example, turning techniques, milling techniques, and drilling techniques. Hand held tools also may be used to manually form or shape features in or on the brown pin 212. Furthermore, cutting tools that include super hard coatings or inserts may be used to facilitate machining of the brown pin 212. Additionally, coatings may be applied to the brown pin 212 prior to machining to reduce chipping of the brown bit body 182. Such coatings may include a fixative or other polymer material.

Figure 5J:
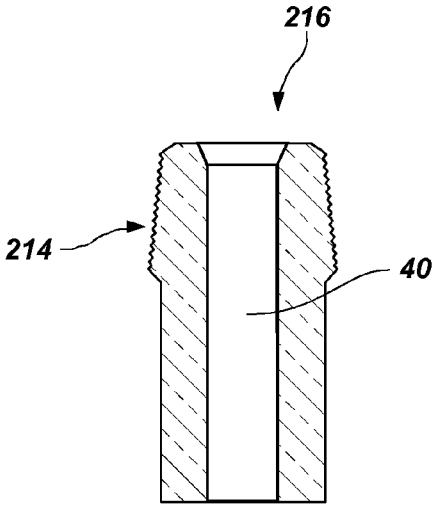

By way of example and not limitation, threads 214 may be formed in the brown pin 212 to form a shaped brown threaded pin 216 shown in FIG. 5J.

Figure 5K:
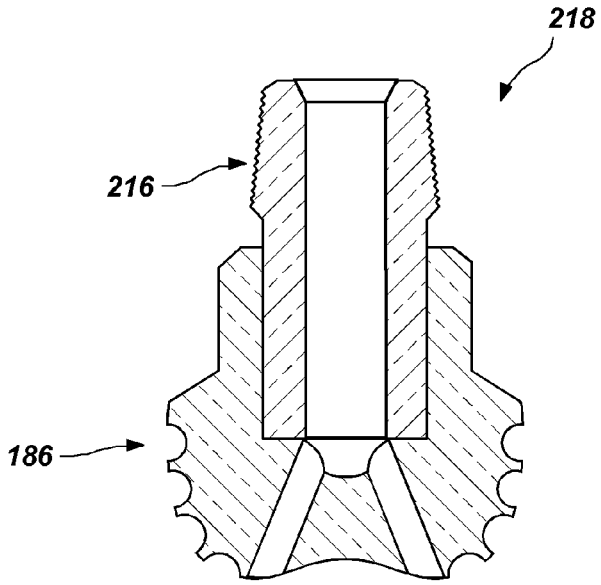

The shaped brown threaded pin 216 shown in FIG. 5J then may be inserted into the previously formed shaped brown bit body 186 shown in FIG. 5E to form a brown unitary structure 218 shown in FIG. 5K. The brown unitary structure 218 then may be fully sintered to a desired final density to provide the unitary structure 151 shown in FIG. 4 and previously described herein. The threaded pin 154 may become bonded and secured to the bit body 152 when the unitary structure is sintered to the desired final density. During all sintering and partial sintering processes, refractory structures or displacements (not shown) may be used to support at least a portion of the unitary structure during densification to maintain desired shapes and dimensions during the densification process, as previously described.

In alternative methods, the shaped green pin 208 shown in FIG. 5H may be inserted into or assembled with the shaped green bit body 178 shown in FIG. 5C to form a green unitary structure. The green unitary structure may be partially sintered to a brown state. The brown unitary structure may then be shaped using conventional machining techniques including, for example, turning techniques, milling techniques, and drilling techniques. The shaped brown unitary structure may then be fully sintered to a desired final density. In yet another alternative method, the shaped brown bit body 186 shown in FIG. 5E may be sintered to a desired final density. The shaped brown threaded pin 216 shown in FIG. 5J may be separately sintered to a desired final density. The fully sintered threaded pin (not shown) may be assembled with the fully sintered bit body (not shown), and the assembled structure may again be heated to sintering temperatures to bond and attach the threaded pin to the bit body.

The sintering processes described above may include any of the subliquidus phase sintering processes previously described herein. For example, the sintering processes described above may be conducted using the Rapid Omnidirectional Compaction (ROC) process, the CERACON™ process, hot isostatic pressing (HIP), or adaptations of such processes.

Another method that may be used to form the drill bit 150 shown in FIG. 4 will now be described with reference to FIGS. 6A-6E. The method involves providing multiple powder mixtures having different material compositions at different regions within a mold or container, and simultaneously pressing the various powder mixtures within the container to form a unitary green powder component.

Figure 6A:
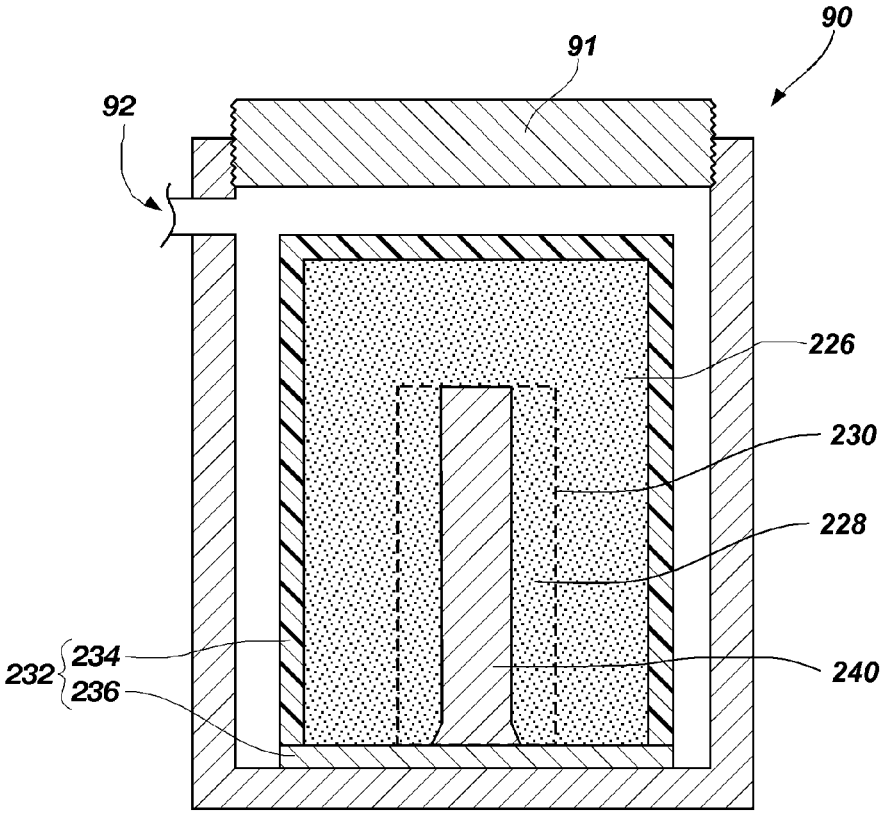
FIGS. 6A-6E illustrate an additional method of forming the earth-boring rotary drill bit shown in FIG. 4.

Referring to FIGS. 6A-6E, the unitary structure 151 (FIG. 4) may be formed in the green state using an isostatic pressing process. As shown in FIG. 6A, a first powder mixture 226 may be provided within a first region of a mold or container 232, and a second powder mixture 228 may be provided within a second region of the container 232. The first region may be loosely defined as the region within the container 232 that is exterior of the phantom line 230, and the second region may be loosely defined as the region within the container 232 that is enclosed by the phantom line 230.

The first powder mixture 226 may include a plurality of hard particles and a plurality of particles comprising a matrix material. The hard particles and the matrix material may be substantially identical to those previously discussed in relation to the drill bit 50 shown in FIG. 2. The second powder mixture 228 may also include a plurality of hard particles and a plurality of particles comprising matrix material, as previously described. The material composition of the second powder mixture 228 may differ, however, from the material composition of the first powder mixture 226. By way of example, the hard particles in the first powder mixture 226 may have a hardness that is higher than a hardness of the hard particles in the second powder mixture 228. Furthermore, the particles of matrix material in the second powder mixture 228 may have a fracture toughness that is higher than a fracture toughness of the particles of matrix material in the first powder mixture 226.

Optionally, each of the first powder mixture 226 and the second powder mixture 228 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The container 232 may include a fluid-tight deformable member 234 and a sealing plate 236. For example, the fluid-tight deformable member 234 may be a substantially cylindrical bag comprising a deformable polymer material. The deformable member 234 may be formed from, for example, an elastomer such as rubber, neoprene, silicone, or polyurethane. The deformable member 232 may be filled with the first powder mixture 226 and the second powder mixture 228. The deformable member 226 and the powder mixtures 226, 228 may be vibrated to provide a uniform distribution of the powder mixtures within the deformable member 234. At least one displacement or insert 240 may be provided within the deformable member 234 for defining features such as, for example, the longitudinal bore 40 (FIG. 4). Alternatively, the insert 240 may not be used and the longitudinal bore 40 may be formed using a conventional machining process during subsequent processes. The sealing plate 236 then may be attached or bonded to the deformable member 234 providing a fluid-tight seal therebetween.

The container 232 (with the first powder mixture 226, the second powder mixture 228, and any desired inserts 240 contained therein) may be provided within a pressure chamber 90. A removable cover 91 may be used to provide access to the interior of the pressure chamber 90. A fluid (which may be substantially incompressible) such as, for example, water, oil, or gas (such as, for example, air or nitrogen) is pumped into the pressure chamber 90 through an opening 92 using a pump (not shown). The high pressure of the fluid causes the walls of the deformable member 234 to deform. The pressure may be transmitted substantially uniformly to the first powder mixture 226 and the second powder mixture 228. The pressure within the pressure chamber 90 during isostatic pressing may be greater than about 35 megapascals (about 5,000 pounds per square inch). More particularly, the pressure within the pressure chamber 90 during isostatic pressing may be greater than about 138 megapascals (20,000 pounds per square inch). In alternative methods, a vacuum may be provided within the container 232 and a pressure greater than about 0.1 megapascal (about 15 pounds per square inch) may be applied to the exterior surfaces of the container 232 (by, for example, the atmosphere) to compact the first powder mixture 226 and the second powder mixture 228. Isostatic pressing of the first powder mixture 226 together with the second powder mixture 228 may form a green powder component or green unitary structure 244 shown in FIG. 6B, which can be removed from the pressure chamber 90 and container 232 after pressing.

Figure 6B:
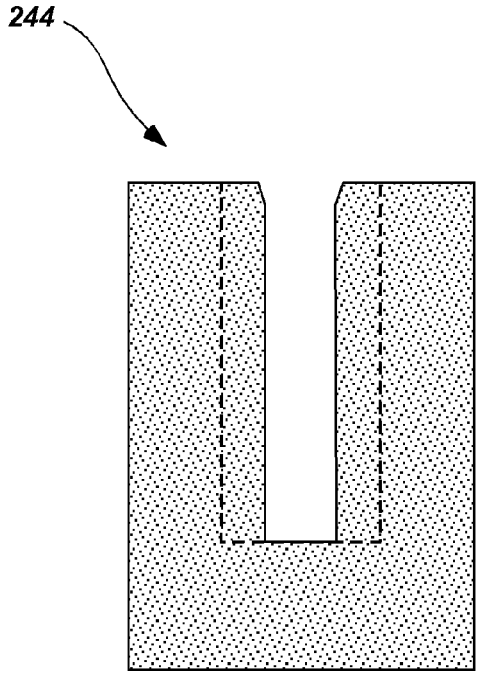

In an alternative method of pressing the powder mixtures 226, 228 to form the green unitary structure 244 shown in FIG. 6B, the powder mixtures 226, 228 may be uniaxially pressed in a mold or die (not shown) using a mechanically or hydraulically actuated plunger by methods that are known to those of ordinary skill in the art of powder processing.

The green unitary structure 244 shown in FIG. 6B may include a plurality of particles held together by binder materials provided in the powder mixtures 226, 228 (FIG. 6A). Certain structural features may be machined in the green unitary structure 244 using conventional machining techniques including, for example, turning techniques, milling techniques, and drilling techniques. Hand held tools also may be used to manually form or shape features in or on the green unitary structure 244.

Figure 6C:
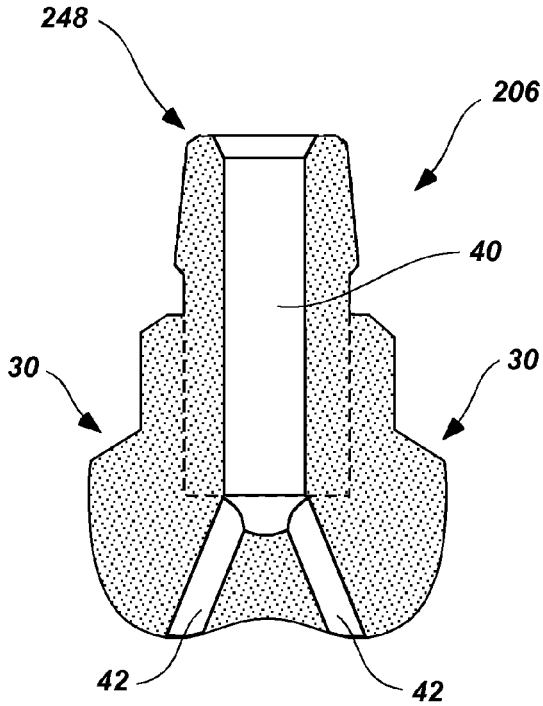

By way of example and not limitation, blades 30, junk slots 32 (FIG. 4), internal fluid courses 42, and a tapered surface 206 may be formed in the green unitary structure 244 to form a shaped green unitary structure 248 shown in FIG. 6C.

Figure 6D:
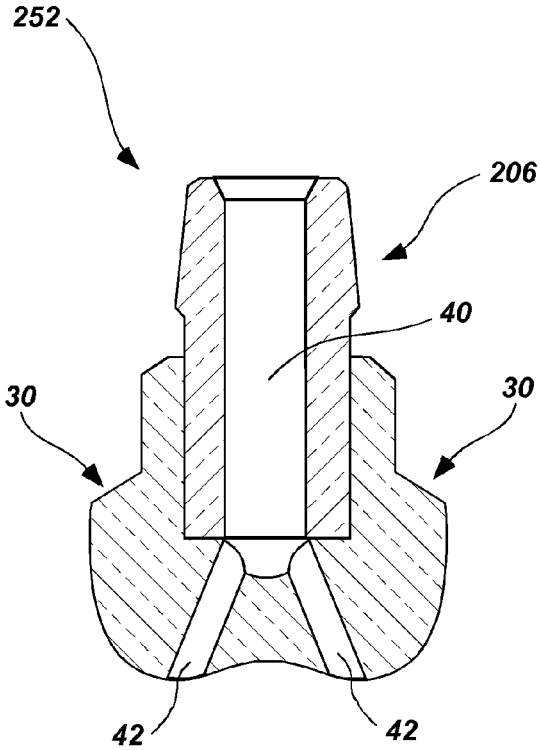

The shaped green unitary structure 248 shown in FIG. 6C may be at least partially sintered to provide a brown unitary structure 252 shown in FIG. 6D, which has less than a desired final density. Prior to at least partially sintering the shaped green unitary structure 248, the shaped green unitary structure 248 may be subjected to elevated temperatures to burn off or remove any fugitive additives that were included in the first powder mixture 226 or the second powder mixture 228 (FIG. 6A) as previously described. Furthermore, the shaped green unitary structure 248 may be subjected to a suitable atmosphere tailored to aid in the removal of such additives. Such atmospheres may include, for example, hydrogen gas at temperatures of about 500° C.

The brown unitary structure 252 may be substantially machinable due to the remaining porosity therein. Certain structural features may be machined in the brown unitary structure 252 using conventional machining techniques including, for example, turning techniques, milling techniques, and drilling techniques. Hand held tools also may be used to manually form or shape features in or on the brown unitary structure 252. Furthermore, cutting tools that include super hard coatings or inserts may be used to facilitate machining of the brown unitary structure 252. Additionally, coatings may be applied to the brown unitary structure 252 prior to machining to reduce chipping of the brown unitary structure 252. Such coatings may include a fixative or other polymer material.

Figure 6E:
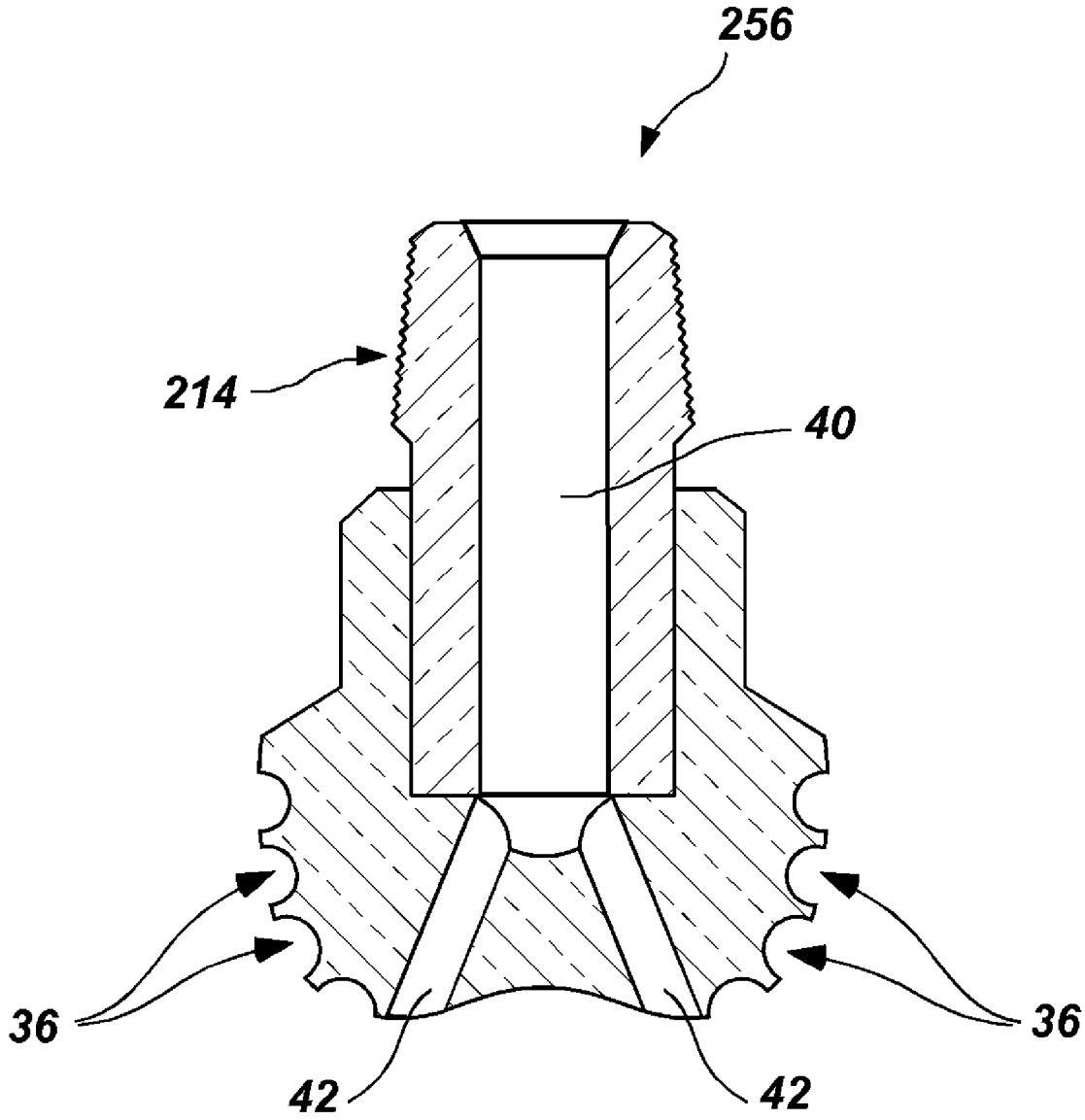

By way of example and not limitation, cutter pockets 36, buttresses 38 (FIG. 4), and threads 214 may be formed in the brown unitary structure 252 to form a shaped brown unitary structure 256 shown in FIG. 6E. Furthermore, if the drill bit 150 (FIG. 4) is to include a plurality of cutters integrally formed with the bit body 152, the cutters may be positioned within the cutter pockets 36 formed in the shaped brown unitary structure 256. Upon subsequent sintering of the shaped brown unitary structure 256, the cutters may become bonded to and integrally formed with the bit body 152 (FIG. 4).

The shaped brown unitary structure 256 shown in FIG. 6E then may be fully sintered to a desired final density to provide the unitary structure 151 shown in FIG. 4 and previously described herein. During all sintering and partial sintering processes, refractory structures or displacements (not shown) may be used to support at least a portion of the bit body during densification to maintain desired shapes and dimensions during the densification process. Such displacements may be used, for example, to maintain consistency in the size and geometry of the cutter pockets 36 and the internal fluid passageways 42 during sintering and densification. Such refractory structures may be formed from, for example, graphite, silica, or alumina. The use of alumina displacements instead of graphite displacements may be desirable as alumina may be relatively less reactive than graphite, thereby minimizing atomic diffusion during sintering. Additionally, coatings such as alumina, boron nitride, aluminum nitride, or other commercially available materials may be applied to the refractory structures to prevent carbon or other atoms in the refractory structures from diffusing into the bit body during densification.

Furthermore, any of the previously described sintering methods may be used to sinter the shaped brown unitary structure 256 shown in FIG. 6E to the desired final density.

In the previously described method, features of the unitary structure 151 were formed by shaping or machining both the green unitary structure 244 shown in FIG. 6B and the brown unitary structure 252 shown in FIG. 6D. Alternatively, all shaping and machining may be conducted on either a green unitary structure or a brown unitary structure. For example, the green unitary structure 244 shown in FIG. 6B may be partially sintered to form a brown unitary structure (not shown) without performing any shaping or machining of the green unitary structure 244. Substantially all features of the unitary structure 151 (FIG. 4) may be formed in the brown unitary structure, prior to sintering the brown unitary structure to a desired final density. Alternatively, substantially all features of the unitary structure 151 (FIG. 4) may be shaped or machined in the green unitary structure 244 shown in FIG. 6B. The fully shaped and machined green unitary structure (not shown) may then be sintered to a desired final density.

Figure 7:
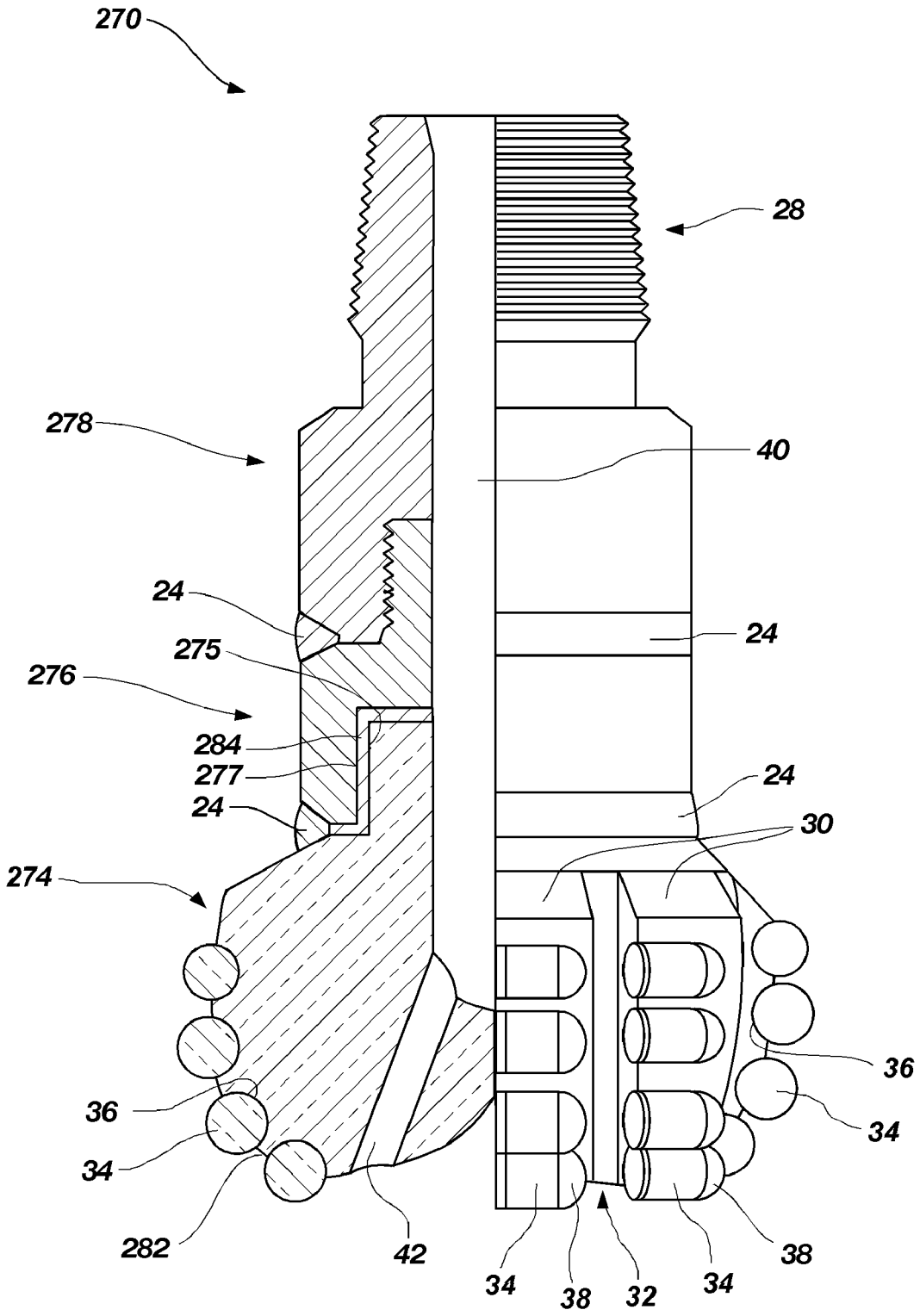
FIG. 7 is a partial cross-sectional side view of yet another earth-boring rotary drill bit that embodies teachings of the present invention and has a bit body that includes a particle-matrix composite material.

An earth-boring rotary drill bit 270 that embodies teachings of the present invention is shown in FIG. 7. The drill bit 270 includes a bit body 274 substantially formed from and composed of a particle-matrix composite material. The drill bit 270 also may include an extension 276 comprising a metal or metal alloy and a shank 278 attached to the bit body 274. By way of example and not limitation, the extension 276 and the shank 278 each may include steel or any other iron-based alloy. The shank 278 may include an API threaded pin 28 for connecting the drill bit 270 to a drill string (not shown).

The bit body 274 may include blades 30, which are separated by junk slots 32. Internal fluid passageways 42 may extend between the face 282 of the bit body 274 and a longitudinal bore 40, which extends through the shank 278, the extension 276, and partially through the bit body 274. Nozzle inserts (not shown) may be provided at face 282 of the bit body 274 within the internal fluid passageways 42.

The drill bit 270 may include a plurality of PDC cutters 34 disposed on the face 282 of the bit body 274. The PDC cutters 34 may be provided along blades 30 within pockets 36 formed in the face 282 of the bit body 270, and may be supported from behind by buttresses 38, which may be integrally formed with the bit body 274. Alternatively, the drill bit 270 may include a plurality of cutters each comprising a wear-resistant abrasive material, such as, for example, a particle-matrix composite material. The particle-matrix composite material of the cutters may have a different composition from the particle-matrix composite material of the bit body 274. Furthermore, such cutters may be integrally formed with the bit body 274.

The particle-matrix composite material of the bit body 274 may include a plurality of hard particles randomly dispersed throughout a matrix material. The hard particles and the matrix material may be substantially identical to those previously discussed in relation to the drill bit 50 shown in FIG. 2.

In one embodiment of the present invention, the particle-matrix composite material of the bit body 274 may include a plurality of tungsten carbide particles having an average diameter in a range from about 0.5 micron to about 20 microns. The matrix material may include a cobalt and nickel-based metal alloy. The tungsten carbide particles may comprise between about 60% and about 95% by weight of the particle-matrix composite material, and the matrix material may comprise between about 5% and about 40% by weight of the particle-matrix composite material.

The bit body 274 is substantially similar to the bit body 52 shown in FIG. 2, and may be formed by any of the methods previously discussed herein in relation to FIGS. 3A-3E.

In conventional drill bits that have a bit body that includes a particle-matrix composite material, a preformed steel blank is used to attach the bit body to a steel shank. The preformed steel blank is attached to the bit body when particulate carbide material is infiltrated by molten matrix material within a mold and the matrix material is allowed to cool and solidify, as previously discussed. Threads or other features for attaching the steel blank to the steel shank can then be machined in surfaces of the steel blank.

As the bit body 274 is not formed using conventional infiltration techniques, a preformed steel blank may not be integrally formed with the bit body 274 in the conventional method. As an alternative method for attaching the shank 278 to the bit body 274, an extension 276 may be attached to the bit body 274 after formation of the bit body 274.

The extension 276 may be attached and secured to the bit body 274 by, for example, brazing or soldering an interface between a surface 275 of the bit body 274 and a surface 277 of the extension 276. For example, the interface between the surface 275 of the bit body 274 and the surface 277 of the extension 276 may be brazed using a furnace brazing process or a torch brazing process. The bit body 274 and the extension 276 may be sized and configured to provide a predetermined standoff between the surface 275 and the surface 277, in which a brazing alloy 284 may be provided. The brazing alloy 284 may include, for example, a silver-based or a nickel-based alloy.

Additional cooperating non-planar surface features (not shown) may be formed on or in the surface 275 of the bit body 274 and an abutting surface 277 of the extension 276 such as, for example, threads or generally longitudinally oriented keys, rods, or splines, which may prevent rotation of the bit body 274 relative to the extension 276.

In alternative embodiments, a press fit or a shrink fit may be used to attach the extension 276 to the bit body 274. To provide a shrink fit between the extension 276 and the bit body 274, a temperature differential may be provided between the extension 276 and the bit body 274. By way of example and not limitation, the extension 276 may be heated to cause thermal expansion of the extension 276 while the bit body 274 may be cooled to cause thermal contraction of the bit body 274. The extension 276 then may be pressed onto the bit body 274 and the temperatures of the extension 276 and the bit body 274 may be allowed to equilibrate. As the temperatures of the extension 276 and the bit body 274 equilibrate, the surface 277 of the extension 276 may engage or abut against the surface 275 of the bit body 274, thereby at least partly securing the bit body 274 to the extension 276 and preventing separation of the bit body 274 from the extension 276.

Alternatively, a friction weld may be provided between the bit body 274 and the extension 276. Abutting surfaces may be provided on the extension 276 and the bit body 274. A machine may be used to press the extension 276 against the bit body 274 while rotating the bit body 274 relative to the extension 276. Heat generated by friction between the extension 276 and the bit body 274 may at least partially melt the material at the mating surfaces of the extension 276 and the bit body 274. The relative rotation may be stopped and the bit body 274 and the extension 276 may be allowed to cool while maintaining axial compression between the bit body 274 and the extension 276, providing a friction welded interface between the mating surfaces of the extension 276 and the bit body 274.

Additionally, a weld 24 may be provided between the bit body 274 and the extension 276 that extends around the drill bit 270 on an exterior surface thereof along an interface between the bit body 274 and the extension 276. A shielded metal arc welding (SMAW) process, a gas metal arc welding (GMAW) process, a plasma transferred arc (PTA) welding process, a submerged arc welding process, an electron beam welding process, or a laser beam welding process may be used to weld the interface between the bit body 274 and the extension 276.

After the extension 276 has been attached and secured to the bit body 274, the shank 278 may be attached to the extension 276. By way of example and not limitation, positioning threads 300 may be machined in abutting surfaces of the steel shank 278 and the extension 276. The steel shank 278 then may be threaded onto the extension 276. A weld 24 then may be provided between the steel shank 278 and the extension 276 that extends around the drill bit 270 on an exterior surface thereof along an interface between the steel shank 278 and the extension 276. Furthermore, solder material or brazing material may be provided between abutting surfaces of the steel shank 278 and the extension 276 to further secure the steel shank 278 to the extension 276.

By attaching an extension 276 to the bit body 274, removal and replacement of the steel shank 278 may be facilitated relative to removal and replacement of shanks that are directly attached to a bit body substantially formed from and composed of a particle-matrix composite material, such as, for example, the shank 70 of the drill bit 50 shown in FIG. 2.

While teachings of the present invention are described herein in relation to embodiments of earth-boring rotary drill bits that include fixed cutters, other types of earth-boring drilling tools such as, for example, core bits, eccentric bits, bicenter bits, reamers, mills, drag bits, roller cone bits, and other such structures known in the art may embody teachings of the present invention and may be formed by methods that embody teachings of the present invention.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. A method of forming an earth-boring rotary drill bit, the method comprising:

pressing a powder mixture to form a green bit body;

sintering the green bit body to form a bit body comprising a particle-matrix composite material having a final density;

attaching a connection member to the bit body after sintering the green bit body, the connection member configured for attachment of a shank to the bit body; and attaching a shank configured for attachment to a drill string to the connection member.

2. The method of claim 1, further comprising selecting the powder mixture to comprise:

a plurality of hard particles selected from the group consisting of diamond, boron carbide, boron nitride, aluminum nitride, and carbides or borides of the group consisting of W, Ti, Mo, Nb, V, Hf, Zr, and Cr; and a plurality of particles comprising a matrix material, the matrix material selected from the group consisting of cobalt-based alloys, iron-based alloys, nickel-based alloys, cobalt and nickel-based alloys, iron and nickel-based alloys, iron and cobalt-based alloys, aluminum-based alloys, copper-based alloys, magnesium-based alloys, and titanium-based alloys.

3. The method of claim 1, wherein sintering the green bit body to form the bit body comprising the particle-matrix composite material having the final density comprises:

partially sintering the green bit body to form a brown bit body;

machining at least one feature in the brown bit body; and sintering the brown bit body to the final density.

4. The method of claim 1, wherein sintering the green bit body to form the bit body comprising the particle-matrix composite material having the final density comprises sub-liquidus phase sintering.

5. The method of claim 1, wherein pressing the powder mixture to form the green bit body comprises isostatically pressing the powder mixture.

6. The method of claim 5, wherein isostatically pressing the powder mixture comprises pressing the powder mixture with a liquid.

7. The method of claim 5, wherein isostatically pressing the powder mixture comprises pressing the powder mixture with pressure greater than about 35 megapascals (about 5,000 pounds per square inch).

8. The method of claim 7, wherein isostatically pressing the powder mixture comprises:

placing the powder mixture in a bag comprising a polymer material; and applying pressure to exterior surfaces of the bag.

9. The method of claim 1, wherein attaching the connection member to the bit body comprises applying a brazing or soldering material to an interface between a surface of the bit body and a surface of the connection member.

10. The method of claim 9, wherein attaching the connection member to the bit body further comprises welding an interface between a surface of the bit body and a surface of the connection member.

11. The method of claim 9, further comprising sizing and configuring each of the bit body and the connection member to provide a predetermined standoff between the surface of the bit body and the surface of the connection member at the interface therebetween.

12. The method of claim 1, wherein attaching the connection member to the bit body comprises welding an interface between a surface of the bit body and a surface of the connection member.

13. The method of claim 1, wherein attaching the connection member to the bit body comprises friction welding or electron beam welding an interface between the bit body and the connection member.

14. The method of claim 1, wherein attaching the connection member to the bit body comprises press fitting or shrink fitting the connection member onto the bit body.

15. The method of claim 1, wherein attaching the shank to the connection member comprises:

providing cooperating threads on abutting surfaces of the shank and the connection member; and threading the shank and the connection member together.

16. The method of claim 15, wherein attaching the shank to the connection member further comprises welding an interface between a surface of the shank and a surface of the connection member.

17. The method of claim 1, further comprising forming the connection member to be at least substantially comprised of metal or metal alloy.

18. The method of claim 1, further comprising positioning at least a portion of the connection member circumferentially around at least a portion of the bit body.

19. An earth-boring rotary drill bit, comprising:

a bit body at least substantially comprised of a sintered particle-matrix composite material;

a connection member attached to the bit body, the connection member configured for attachment of a shank to the bit body;

a braze or solder material at an interface between the bit body and the connection member;

a shank attached to the connection member, the shank configured for attachment to a drill string; and at least one of threads, a weld, a brazing material, or solder material at an interface between the connection member and the shank.

20. The earth-boring rotary drill bit of claim 19, wherein the at least one of threads, a weld, a brazing material, or solder material at an interface between the connection member and the shank comprises a weld between the bit body and the connection member.

* * * * *